US010553144B2

(12) United States Patent
Tsuchida

(10) Patent No.: US 10,553,144 B2
(45) Date of Patent: Feb. 4, 2020

(54) DISPLAY DEVICE, DISPLAY DEVICE CORRECTION METHOD, DISPLAY DEVICE MANUFACTURING METHOD, AND DISPLAY DEVICE DISPLAY METHOD

(71) Applicant: JOLED INC., Tokyo (JP)

(72) Inventor: Shinya Tsuchida, Tokyo (JP)

(73) Assignee: JOLED INC., Tokyo (JP)

( * ) Notice: Subject to any disclaimer, the term of this patent is extended or adjusted under 35 U.S.C. 154(b) by 0 days.

(21) Appl. No.: 15/661,417

(22) Filed: Jul. 27, 2017

(65) Prior Publication Data

US 2018/0047326 A1 Feb. 15, 2018

(30) Foreign Application Priority Data

Aug. 9, 2016 (JP) ..... 2016-156726

(51) Int. Cl.

| | |
|---|---|
| ***G09G 3/20*** | (2006.01) |
| ***G09G 5/02*** | (2006.01) |
| ***G09G 3/3233*** | (2016.01) |
| *G09G 3/3266* | (2016.01) |
| *G09G 3/3291* | (2016.01) |

(52) U.S. Cl.

CPC ..... *G09G 3/2003* (2013.01); *G09G 3/2059* (2013.01); *G09G 3/2074* (2013.01); *G09G 3/3233* (2013.01); *G09G 3/3266* (2013.01); *G09G 3/3291* (2013.01); *G09G 2300/0452* (2013.01); *G09G 2320/0233* (2013.01)

(58) Field of Classification Search

CPC ..... G09G 3/2003; G09G 5/02

See application file for complete search history.

(56) References Cited

U.S. PATENT DOCUMENTS

2004/0061710 A1* 4/2004 Messing ..... G06T 3/4015 345/698
2005/0140584 A1* 6/2005 Kim ..... G09G 3/2022 345/60
2006/0233251 A1* 10/2006 Kim ..... H04N 19/139 375/240.12

(Continued)

FOREIGN PATENT DOCUMENTS

WO 2011/118124 9/2011

*Primary Examiner* — Yi Yang

(74) *Attorney, Agent, or Firm* — Greenblum & Bernstein, P.L.C.

(57) ABSTRACT

Provided is a correction method performed in a display device including a matrix of pixels each including an organic EL element that emits light in accordance with a luminance signal. The method includes: obtaining, in advance, first correction data for correcting the luminance signal; transforming the first correction data into second correction data smaller in data size than the first correction data; and correcting the luminance signal using the second correction data. The first and second correction data respectively include first color correction data for correcting first sub pixel luminance, second color correction data for correcting second sub pixel luminance, and third color correction data for correcting third sub pixel luminance. In the transforming, the first correction data is transformed such that a data reduction amount of the second color correction data is greater than a data reduction amount of the first color correction data.

21 Claims, 21 Drawing Sheets

(56) References Cited

U.S. PATENT DOCUMENTS

| | | | | |
|---|---|---|---|---|
| 2012/0062584 | A1* | 3/2012 | Furukawa | H04N 9/3111 345/589 |
| 2012/0114045 | A1* | 5/2012 | Teng | H04N 7/50 375/240.24 |
| 2013/0021389 | A1* | 1/2013 | Odawara | G09G 3/3233 345/690 |

* cited by examiner

FIG. 15

| | R | | | | G | | | | B | | | |
|---|---|---|---|---|---|---|---|---|---|---|---|---|
| First correction data | 1.109 | 1.143 | 1.089 | 1.103 | 1.063 | 1.054 | 1.062 | 1.067 | 1.151 | 1.131 | 1.118 | 1.122 |
| | 1.067 | 1.075 | 1.064 | 1.058 | 1.025 | 0.997 | 0.992 | 1.015 | 1.123 | 1.035 | 1.047 | 1.069 |
| | 1.095 | 1.061 | 1.050 | 1.047 | 1.020 | 1.015 | 0.962 | 1.023 | 1.108 | 1.035 | 1.032 | 1.050 |
| | 1.101 | 1.028 | 1.044 | 1.047 | 1.036 | 0.992 | 0.994 | 0.994 | 1.113 | 1.017 | 1.030 | 1.039 |
| Correction data being error diffused = second correction data (decompressed) | 1.101 | 1.121 | 1.101 | 1.101 | 1.060 | 1.060 | 1.060 | 1.069 | 1.116 | 1.116 | 1.116 | 1.116 |
| | 1.081 | 1.081 | 1.061 | 1.061 | 1.021 | 1.002 | 0.992 | 1.011 | 1.116 | 1.061 | 1.061 | 1.061 |
| | 1.101 | 1.061 | 1.040 | 1.061 | 1.021 | 1.011 | 0.963 | 1.021 | 1.116 | 1.061 | 1.005 | 1.061 |
| | 1.101 | 1.020 | 1.040 | 1.040 | 1.040 | 0.992 | 0.992 | 0.992 | 1.116 | 1.005 | 1.061 | 1.005 |
| Second correction data | 6 | 7 | 6 | 6 | 12 | 12 | 12 | 13 | 3 | 3 | 3 | 3 |
| | 5 | 5 | 4 | 4 | 8 | 6 | 5 | 7 | 3 | 2 | 2 | 2 |
| | 6 | 4 | 3 | 4 | 8 | 7 | 2 | 8 | 3 | 2 | 1 | 2 |
| | 6 | 2 | 3 | 3 | 10 | 5 | 5 | 5 | 3 | 1 | 2 | 1 |
| | 3-bit | | | | 4-bit | | | | 2-bit | | | |

DISPLAY DEVICE, DISPLAY DEVICE CORRECTION METHOD, DISPLAY DEVICE MANUFACTURING METHOD, AND DISPLAY DEVICE DISPLAY METHOD

CROSS REFERENCE TO RELATED APPLICATION

The present application is based on and claims priority of Japanese Patent Application No. 2016-156726 filed on Aug. 9, 2016. The entire disclosure of the above-identified application, including the specification, drawings and claims is incorporated herein by reference in its entirety.

FIELD

The present disclosure relates to a display device, a display device correction method, a display device manufacturing method, and a display device display method.

BACKGROUND

One example of a known display device that uses current-driven light emitting elements is an organic electroluminescent (EL) display. Organic EL displays have gained attention due to their wide viewing angle and low power consumption.

Usually, in organic EL displays, the organic EL elements that form the pixels are arranged in a matrix. In active matrix organic EL displays in particular, even if there is an increase in the duty cycle, this increase does not lead to a reduction in luminance due to the display's ability to illuminate the organic EL elements until the next scan (selection). This makes it possible to drive the display at a low voltage, resulting in lower power consumption. However, one shortcoming of active matrix organic EL displays is that they are susceptible to appearing uneven in luminance due to the luminances between interpixel organic EL elements being different even when the same luminance signal is applied, caused by variances in driver transistor and/or organic EL element characteristics.

One proposed conventional method for correcting luminance unevenness in an organic EL display device is a compensation method for non-uniform interpixel characteristics involving correcting luminance signals using correction data stored in advance in memory.

For example, Patent Literature (PTL) 1 discloses a manufacturing method for an organic EL display device including obtaining, in a display panel including pixels including organic EL elements and driver transistors, representative current-voltage characteristics, luminance-current characteristics of each partitioned region, and luminance-current characteristics of each pixel, and obtaining correction data for each pixel that corrects the obtained current-voltage characteristics for each pixel to the representative current-voltage characteristics. With this, since precise correction data is obtained, unevenness in the degradation in luminance with age can be inhibited.

CITATION LIST

Patent Literature

[PTL 1] WO 2011/118124

SUMMARY

Technical Problem

However, with the organic EL display device disclosed in PTL 1, correction data (gain and offset) derived in advance for each pixel is stored in memory in the control circuit. Accordingly, when the resolution of the display panel is increased and the precision of the correction data is maintained, there is a problem that the size of the correction data significantly increases. This is a serious problem in particular with, for example, compact, high-definition tablet devices, which are in high demand.

The present disclosure has been conceived in view of the above problem and has an object to provide a display device, a display device correction method, a display device manufacturing method, and a display device display method with reduced correction data size.

Solution to Problem

In order to solve the above problem, according to one aspect of the present invention, a display device correction method for correcting luminance unevenness in a display device including a matrix of pixels each including a light emitting element that emits light in accordance with a luminance signal, includes: obtaining, in advance, first correction data for correcting the luminance signal, the first correction data including correction data components corresponding to the pixels; transforming the first correction data into second correction data smaller in data size than the first correction data; and correcting the luminance signal using the second correction data. The pixels each include at least a first sub pixel that emits light of a first color, a second sub pixel that emits light of a second color, and a third sub pixel that emits light of a third color. The first correction data and the second correction data respectively include at least first color correction data for correcting a luminance of the first sub pixel, second color correction data for correcting a luminance of the second sub pixel, and third color correction data for correcting a luminance of the third sub pixel. In the transforming, the first correction data is transformed such that a data reduction amount of the second color correction data is greater than a data reduction amount of the first color correction data.

Moreover, according to one aspect of the present invention, a display device manufacturing method for manufacturing a display device including a matrix of pixels each including a light emitting element that emits light in accordance with a luminance signal, includes: forming a display panel including the pixels; obtaining, in advance, first correction data for correcting the luminance signal, the first correction data including correction data components corresponding to the pixels; transforming the first correction data into second correction data smaller in data size than the first correction data; correcting the luminance signal using the second correction data; and storing the second correction data in memory included in the display device after the transforming. The pixels each include at least a first sub pixel that emits light of a first color, a second sub pixel that emits light of a second color, and a third sub pixel that emits light of a third color. The first correction data and the second correction data respectively include at least first color correction data for correcting a luminance of the first sub pixel, second color correction data for correcting a luminance of the second sub pixel, and third color correction data for correcting a luminance of the third sub pixel, and in the transforming. The first correction data is transformed such that a data reduction amount of the second color correction data is greater than a data reduction amount of the first color correction data.

Moreover, according to one aspect of the present invention, a display device display method for a display device including a matrix of pixels each including a light emitting element that emits light in accordance with a luminance signal, includes: correcting the luminance signal using second correction data generated by (i) obtaining, in advance, first correction data for correcting the luminance signal, the first correction data including correction data components corresponding to the pixels and (ii) transforming the first correction data into second correction data smaller in data size than the first correction data; and supplying the luminance signal corrected in the correcting to the pixels to cause the light emitting element to emit light in accordance with the luminance signal and the display device to display an image. The pixels each include at least a first sub pixel that emits light of a first color, a second sub pixel that emits light of a second color, and a third sub pixel that emits light of a third color. The first correction data and the second correction data respectively include at least first color correction data for correcting a luminance of the first sub pixel, second color correction data for correcting a luminance of the second sub pixel, and third color correction data for correcting a luminance of the third sub pixel. In the transforming, the first correction data is transformed such that a data reduction amount of the second color correction data is greater than a data reduction amount of the first color correction data.

Moreover, according to one aspect of the present invention, a display device including a matrix of pixels each including a light emitting element that emits light in accordance with a luminance signal, includes: a transform unit configured to transform first correction data for correcting the luminance signal into second correction data smaller in data size than the first correction data, the first correction data including correction data components corresponding to the pixels; and a correcting unit configured to correct the luminance signal using the second correction data. The pixels each include at least a first sub pixel that emits light of a first color, a second sub pixel that emits light of a second color, and a third sub pixel that emits light of a third color. The first correction data and the second correction data respectively include at least first color correction data for correcting a luminance of the first sub pixel, second color correction data for correcting a luminance of the second sub pixel, and third color correction data for correcting a luminance of the third sub pixel. The transform unit is configured to transform the first correction data such that a data reduction amount of the second color correction data is greater than a data reduction amount of the first color correction data.

Advantageous Effects

With a display device, a display device correction method, a display device manufacturing method, and a display device display method according to the present disclosure, a luminance signal is corrected using second correction data smaller in data size than first correction data, and thus correction data size can be reduced.

BRIEF DESCRIPTION OF DRAWINGS

These and other objects, advantages and features of the disclosure will become apparent from the following description thereof taken in conjunction with the accompanying drawings that illustrate a specific embodiment of the present disclosure.

FIG. 15 illustrates a detailed example of the first correction data, the correction data being error diffused, the second correction data, and the second correction data (decompressed second correction data) according to Embodiment 4.

DESCRIPTION OF EMBODIMENTS

Hereinafter, exemplary embodiments of the display device and the display device correction method will be described in detail with reference to the drawings. Note that each of the exemplary embodiments described below represents a preferred, specific example of the present disclosure. The numerical values, shapes, materials, elements, the arrangement and connection of the elements, steps, the processing order of the steps, etc. shown in the following exemplary embodiments are mere examples, and therefore do not limit the scope of the present disclosure, which is defined by the appended claims. Thus, among the elements in the following exemplary embodiments, those not recited in any one of the independent claims which indicate the broadest inventive concepts are described as optional elements.

Note that the figures are schematic diagrams and are not necessarily precise illustrations. Additionally, components that are essentially the same share like reference signs in the figures. Accordingly, overlapping explanations thereof are omitted or simplified.

Embodiment 1

(1.1 Display Device Configuration)

Figure 1:
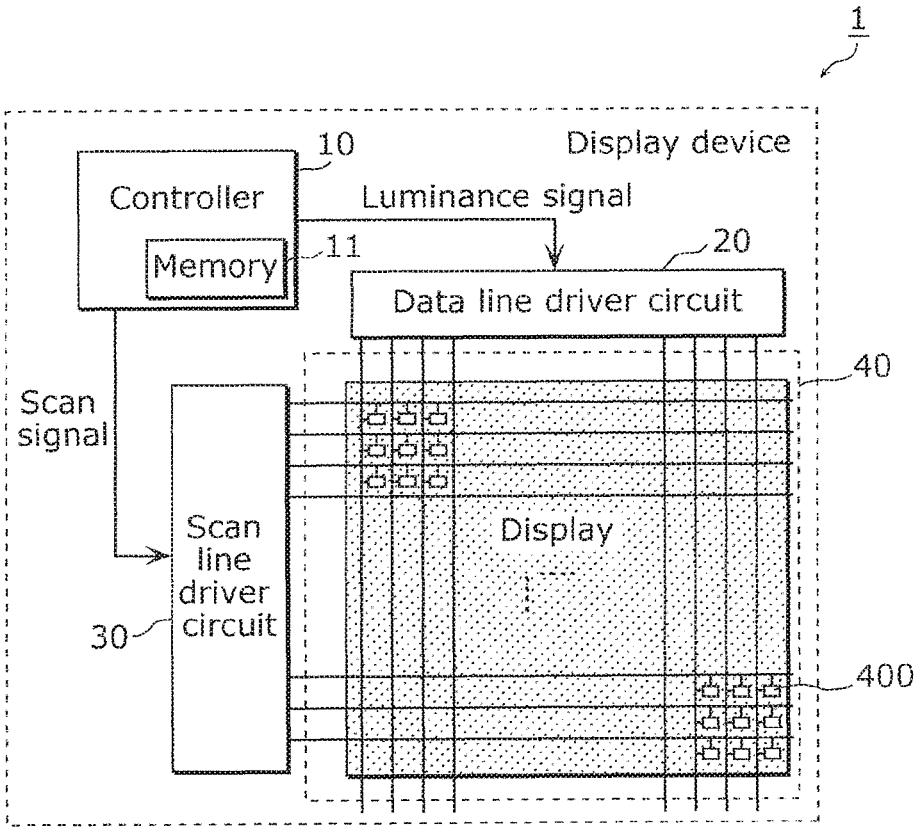
FIG. 1 is a block diagram illustrating a configuration of the display device according to Embodiment 1.

FIG. 1 is a block diagram illustrating a configuration of the display device 1 according to Embodiment 1. The display device 1 illustrated n FIG. 1 includes a controller 10, a data line driver circuit 20, a scan line driver circuit 30, and a display 40. The controller 10 includes memory 11. Note that the memory 11 may be included in the display device 1, external from the controller 10.

The controller 10 controls the memory 11, the data line driver circuit 20, and the scan line driver circuit 30. For example, after manufacturing of the display device 1 is complete, processed correction data (second correction data; to be described later) is stored in the memory 11.

When the display is operating, the controller 10 reads the second correction data written to the memory 11, and based on the second correction data, corrects a video signal (luminance signal) input from an external source and outputs the corrected signal to the data line driver circuit 20.

Moreover, when, for example, unprocessed correction data (first correction data; to be described later) is generated during manufacturing, the controller 10, for example, communicates with an external information processing device, and drives the data line driver circuit 20 and the scan line driver circuit 30 in accordance with instruction from the information processing device.

For example, the controller 10 applies a transform to unprocessed correction data (first correction data) during manufacturing to generate processed (transformed) correction data (second correction data), and stores the processed correction data in the memory 11.

The display 40 includes pixels arranged in a matrix, and displays an image based on a video signal (luminance signal) input from an external source to display device 1.

Each pixel includes three sub pixels 400 that each emit a different color corresponding to one of the three primary colors of light. Here, each pixel is exemplified as including a red sub pixel that emits red light, a green sub pixel that emits green light, and a blue sub pixel that emits blue light.

Figure 2:
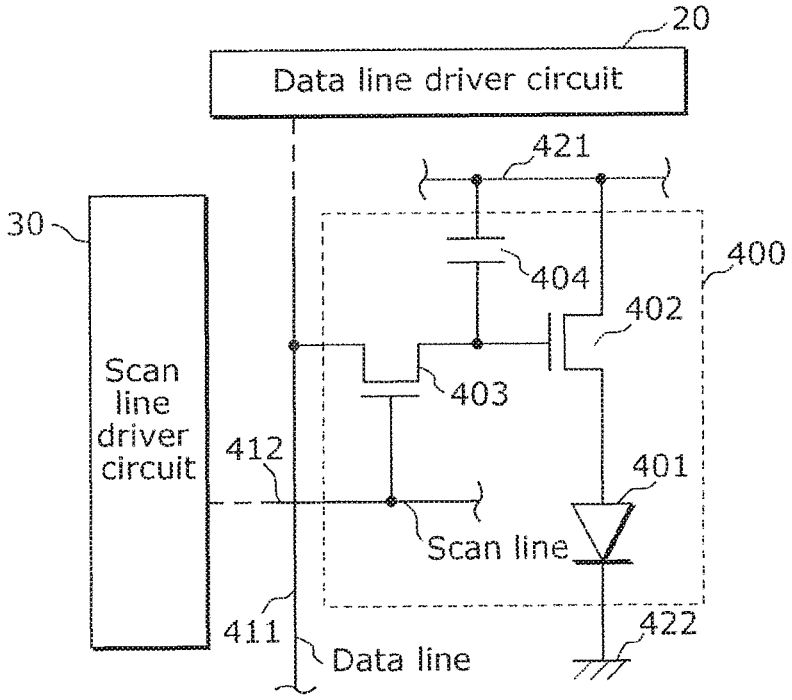
FIG. 2 illustrates the connectivity between one example of a circuit configuration of a sub pixel according to Embodiment 1 and surrounding circuits.

FIG. 2 illustrates the connectivity between one example of a circuit configuration of a sub pixel 400 according to Embodiment 1 and surrounding circuits. The sub pixel 400 in FIG. 2 includes a scan line 412, a data line 411, a power line 421, a selection transistor 403, a driver transistor 402, an organic EL element 401, a holding capacitor 404, and a common electrode 422. The surrounding circuits include the data line driver circuit 20 and the scan line driver circuit 30.

The scan line driver circuit 30 is connected to the scan line 412, and controls the conductivity of the selection transistor 403 in the sub pixel 400.

The data line driver circuit 20 is connected to the data line 411, and has a function of outputting data voltage, which is a luminance signal corrected using the second correction data, and determining the signal current that flows to driver transistor 402.

The selection transistor 403 has a gate terminal connected to the scan line 412, and controls the timing at which the data voltage from the data line 411 is supplied to the gate terminal of the driver transistor 402.

The driver transistor 402 has a gate terminal connected to the data line 411 via the selection transistor 403, a source terminal connected to an anode terminal of the organic EL element 401, and a drain terminal connected to the power line 421. With this, the driver transistor 402 transforms the data voltage supplied to its gate terminal into a signal current corresponding to the data voltage, and supplies the transformed signal current to the organic EL element 401.

The organic EL element 401 functions as a light emitting element, and the cathode of the organic EL element 401 is connected to the common electrode 422.

Here, a red filter is formed on the red sub pixel included in the organic EL element 401, a green filter is formed on the green sub pixel included in the organic EL element 401, and a blue filter is formed on the blue sub pixel included in the organic EL element 401.

The holding capacitor 404 is connected between the power line 421 and the gate terminal of the driver transistor 402. The holding capacitor 404, for example, maintains the previous gate voltage even after the selection transistor 403 turns OFF, whereby the drive current can be continuously supplied from the driver transistor 402 to the organic EL element 401.

Although not illustrated in FIG. 1 or FIG. 2, note that the power line 421 is connected to a power source. The common electrode 422 is also connected to a power source.

The data voltage supplied from the data line driver circuit 20 is applied to the gate terminal of the driver transistor 402 via the selection transistor 403. The driver transistor 402 passes current in accordance with the data voltage across the source and drain terminals. The current flows to the organic EL element 401, causing the organic EL element 401 to emit light of a luminance corresponding to the current.

Note that in the configuration of the circuit of the sub pixel 400 illustrated in FIG. 2, other circuit components or lines may be inserted along the paths connecting the circuit components.

(1.2 Controller Configuration)

Figure 3:
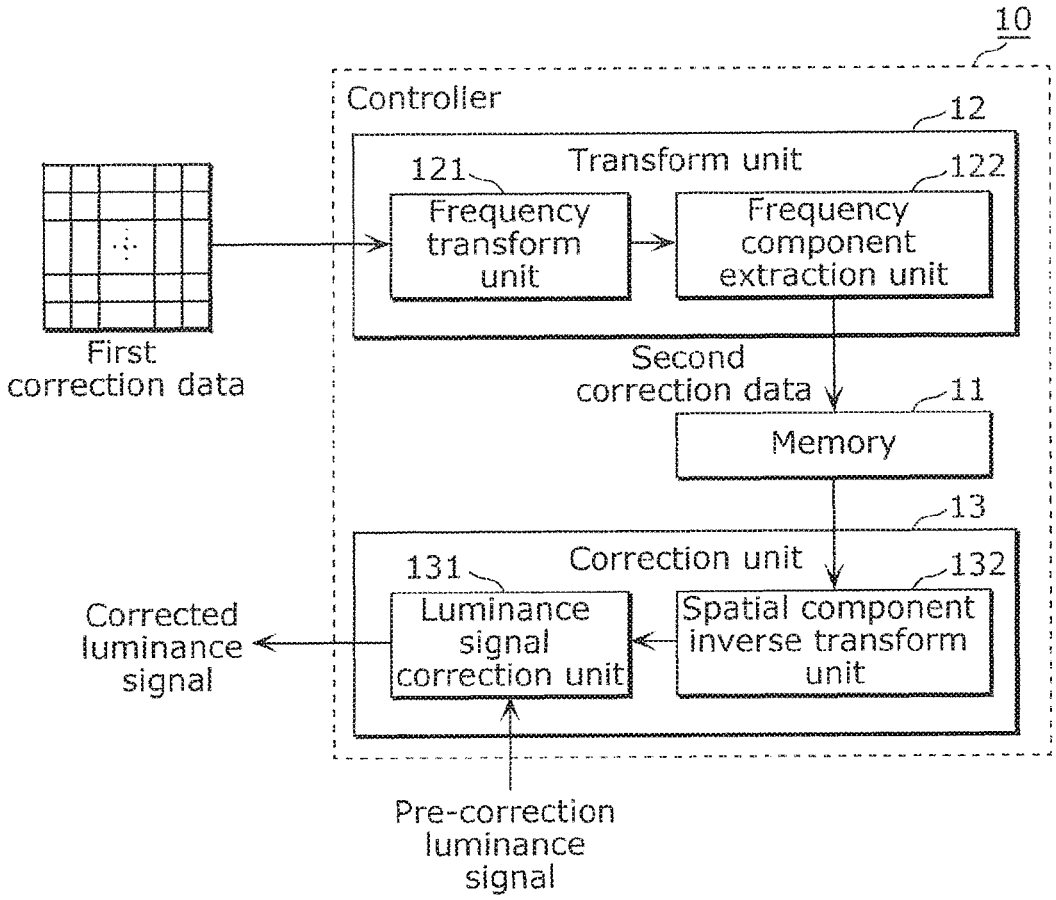
FIG. 3 is a block diagram illustrating a configuration of the controller included in the display device according to Embodiment 1.

FIG. 3 is a block diagram illustrating a configuration of the controller 10 included in the display device 1 according to Embodiment 1. The controller 10 illustrated in FIG. 3 includes the memory 11, a transform unit 12, and a correction unit 13.

The transform unit 12 transforms unprocessed correction data (first correction data) into second correction data smaller in data size than the first correction data.

The correction unit 13 uses the second correction data to correct the luminance signal. The luminance signal is an electric signal for causing light emitting elements in pixels to emit light, and is applied to the pixels. More specifically, in this embodiment, the luminance signal is data voltage applied from the data line driver circuit 20 to the gate of the driver transistor 402 in order to cause the organic EL element 401 included in the sub pixel 400 to emit light.

Next, unprocessed correction data (first correction data) will be described. For example, the first correction data is data for reducing luminance unevenness when the sub pixels 400 in the display 40 emit light based on a video signal transmitted from an external source to the display device 1. More specifically, for example, the correction data includes two correction parameters corresponding to a sub pixel 400: a gain correction value and an offset correction value. Note that the correction data need not correspond to a sub pixel 400, and may correspond to a group of neighboring sub pixels.

Figure 4:
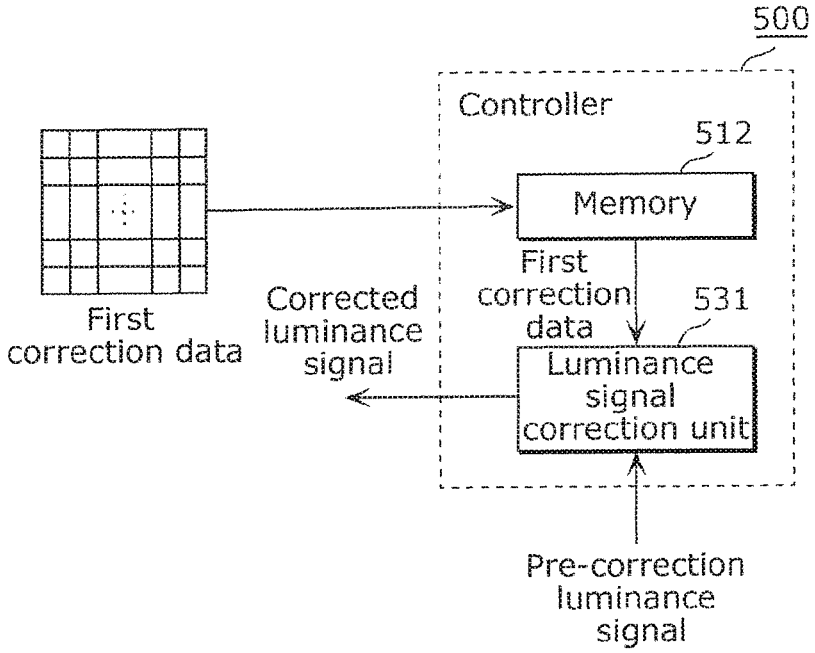
FIG. 4 Prior Art
FIG. 4 is a block diagram illustrating a configuration of a controller included in a conventional display device.

FIG. 4 is a block diagram illustrating a configuration of a controller 500 included in a conventional display device. The controller 500 illustrated in FIG. 4 includes memory 512 and a luminance signal correction unit 531. In this conventional display device, the controller 500 stores the first correction data in the memory 512 in advance. Moreover, the controller 500 transforms a video signal to generate a luminance signal (pre-correction luminance signal) per sub pixel. The luminance signal correction unit 531 reads the first correction data from the memory 512, multiplies (or divides) the gain correction value and adds (or subtracts) the offset correction value of the first correction data with the pre-correction luminance signal to correct the pre-correction luminance signal. The controller 500 outputs the corrected luminance signal to a line driver circuit at a predetermined timing. This is how luminance unevenness is reduced in the display.

A problem with this conventional display device is that the size of the correction data to be stored in the memory 512 increases with an increase in the resolution of the display, and the data transfer rate of, for example, the luminance signal increases. In particular, with compact, high-definition tablet devices, which are in high demand, usage of large capacity memories is problematic, and leads to an increase in cost.

In contrast, with the display device 1 according to this embodiment, the luminance signal is not corrected by the first correction data (unprocessed correction data), but rather by processed correction data (second correction data) obtained by processing the unprocessed correction data (first correction data) so as to reduce its data size. Hereinafter, the configuration of the display device 1 according to this embodiment for generating the second correction data from the first correction data will be described.

The transform unit 12 includes a frequency transform unit 121 and a frequency component extraction unit 122.

The frequency transform unit 121 deconstructs the first correction data represented in spatial components into frequency components. Here, the first correction data includes red correction data for correcting the luminance of red sub pixels, green correction data for correcting the luminance of green sub pixels, and blue correction data for correcting the luminance of blue sub pixels. As such, the frequency transform unit 121 deconstructs the red correction data, green correction data, and blue correction data included in the first correction data into frequency components.

For example, a Fourier transform, in particular a discrete cosine transform is used to transform the data components of the first correction data from spatial components to frequency components. Using a discrete cosine transform makes it possible to efficiently remove specific frequency components in the frequency component extraction unit 122 down the line.

The frequency component extraction unit 122 removes predetermined high frequency components from the correction data transformed into frequency components by the frequency transform unit 121. Here, for each of the red correction data, the green correction data, and the blue correction data, the removal of high frequency components is performed by the frequency component extraction unit 122 such that more high frequency components are removed for colors having a lower luminosity factor. This method of removing high frequency components is performed based on the attribute that humans comparatively recognize changes in luminance of colors having a relatively lower luminosity factor less than changes in luminance of colors having a relatively higher luminosity factor. Typically, the luminosity factor for blue light is less than the luminosity factor for red light, and the luminosity factor for red light is less than the luminosity factor for green light. Accordingly, the frequency component extraction unit 122 removes the high frequency components such that the cutoff frequency for the blue correction data high frequency components is lower than the cutoff frequency for the red correction data, and the cutoff frequency for the red correction data high frequency components is lower than the cutoff frequency for the green correction data. As a result of the frequency component extraction unit 122 removing only the high frequency components from the frequency components included in the correction data, correction data components that correct variations in luminance in units of one sub pixel to a plurality of sub pixels can be omitted. In this case, the frequency component extraction unit 122 includes the function of a low pass filter (a filter that removes signals of high frequencies), thereby making it possible to generate second correction data removed of only high frequency components.

The memory 11 stores the second correction data generated by the transform unit 12 applying a transform to the first correction data. Since the second correction data is generated by removing frequency components higher than a predetermined frequency from the first correction data, the second correction data is smaller in data size than the first correction data. This results in the advantageous effect that the capacity of the memory 11 that stores the second correction data reduced in data size by the transform unit 12 can be reduced when the resolution of the display 40 is increased. Since there is no need to have an excessively large capacity and long lifespan for the storage medium, for example, non-volatile memory, such as flash memory, can be used as the memory 11.

The correction unit 13 includes a spatial component inverse transform unit 132 and a luminance signal correction unit 131.

The spatial component inverse transform unit 132 includes, for example, first memory that is volatile, such as DRAM, and an operation circuit. The spatial component inverse transform unit 132 reads second correction parameters from the memory 11 and temporarily stores them in the first memory. The operation circuit then applies an inverse transform to the second correction data represented in frequency components to yield spatial components.

The luminance signal correction unit 131 corrects the luminance signal corresponding to a sub pixel 400 using the second correction data represented in spatial components generated by the spatial component inverse transform unit 132. Hereinafter, one example of the processes for correcting the luminance signal in the luminance signal correction unit 131 will be given.

The luminance signal correction unit 131 multiplies (or divides) data voltage corresponding to the pre-correction luminance signal by the gain correction value among the second correction parameters represented in spatial components, and adds (or subtracts) the offset correction value among the second correction parameters to (or from) the multiplication value, and outputs the result to the data line driver circuit 20. This makes it possible to maintain the precision of the luminance correction and reduce the correction data size.

Note that in the display device 1 according to this embodiment, the transform unit 12 corresponds to an encoding processor that applies a frequency transform to correction data and removes predetermined high frequency components, and the correction unit 13 corresponds to a decoding processor that inverse transforms (restores) the correction data to spatial components. The transform unit 12 and the correction unit 13 may be realized as integrated circuits (IC) by large scale integration (LSI). Moreover, the method of integration may be a dedicated circuit or a generic processor. A Field Programmable Gate Array (FPGA) or a reconfigurable processor that allows reconfiguration of the connection or configuration of the inner circuit cells of the LSI circuit can be used for the same purpose. Further, if integrated circuit technology that replaces LSI is newly created from advances in or derivations of semiconductor technology, integration of functional blocks using such technology may also be used. Moreover, the transform unit 12 and the correction unit 13 may be realized as a program that executes the above-described encoding and decoding processing, and may be realized as a computer-readable non-transitory recording medium storing such a program. Examples of the computer-readable non-transitory recording medium include flexible disk, hard disk, CD-ROM, MO, DVD, DVD-ROM, DVD-RAM, Blu-Ray™ (BR) disc, and semiconductor memory. It goes without saying that such a program can be distributed via a recordable medium such as a CD-ROM or over a transmission medium such as the internet.

Figure 5:
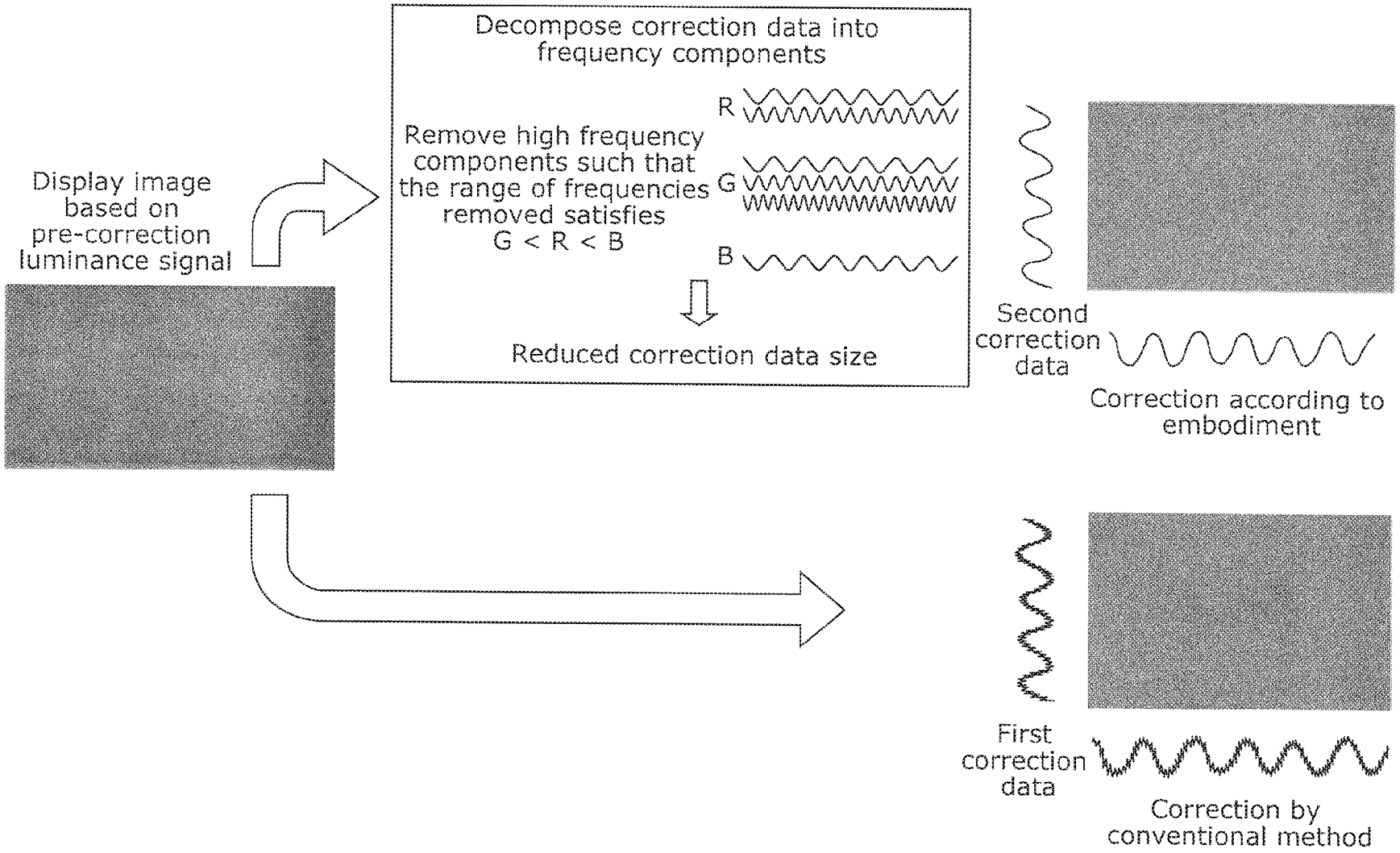
FIG. 5 illustrates a comparison of correction processes and the results thereof between the display device according to Embodiment 1 and a conventional display device.
Figure 14:
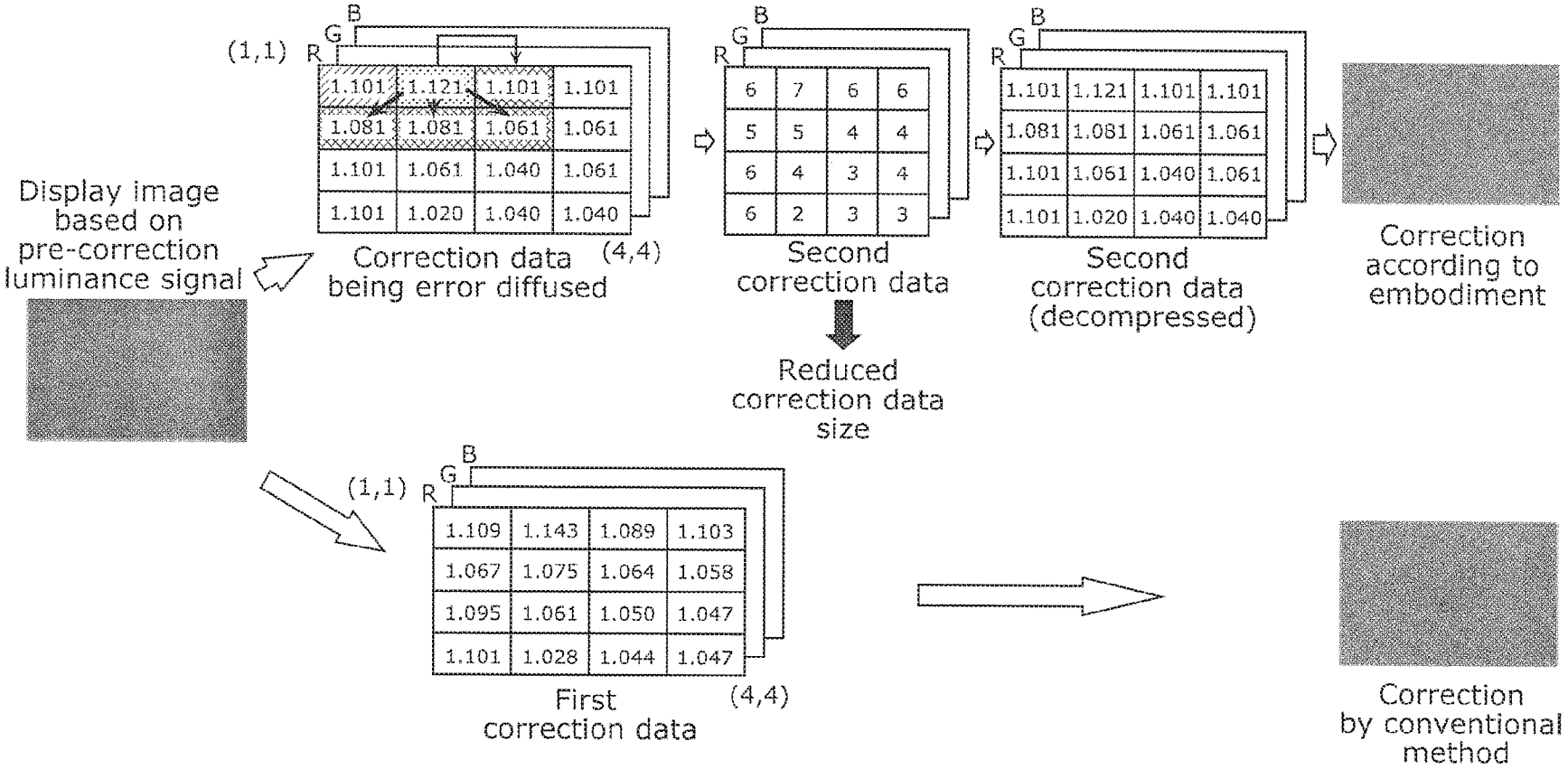
FIG. 14 illustrates a comparison of correction processes and the results thereof between the display device according to Embodiment 4 and a conventional display device.

FIG. 5 illustrates a comparison of correction processes and the results thereof between the display device 1 according to Embodiment 1 and a conventional display device. The display image on the left in FIG. 14 is one example of an image displayed by the display when a pre-correction luminance signal is used when causing the entire display to emit a uniform luminance. In contrast, the display image in the top right region of FIG. 5 is an image displayed by the display when a luminance signal is corrected by the controller 10 of the display device 1 according to this embodiment. The display image in the bottom right region of FIG. 5 is an image displayed by the display when a luminance signal is corrected by the controller 500 according to the conventional display device.

The displayed display image based on the luminance signal corrected by the controller 10 according to this embodiment and the displayed display image based on the luminance signal corrected by the conventional controller 500 both exhibit greatly reduced luminance unevenness compared to the display image based on the pre-correction luminance signal. However, the frequency components of the correction data (illustrated along the long and short sides of the display images in FIG. 5) for the display image corrected by the controller 10 according to this embodiment and the frequency components of the correction data for the display image corrected by the conventional controller 500 are different. In other words, the second correction data processed by the controller 10 according to this embodiment is smaller in data size than the first correction data used by the conventional controller 500 by the amount of high frequency components removed. Thus, with the display device 1 according to this embodiment, even if the number of pixels in the display is increased, the precision of the luminance correction can be maintained and the correction data size can be reduced.

(1.3 Display Device Correction Method)

Next, the correction method performed by the display device 1 according to this embodiment will be described.

Figure 6:
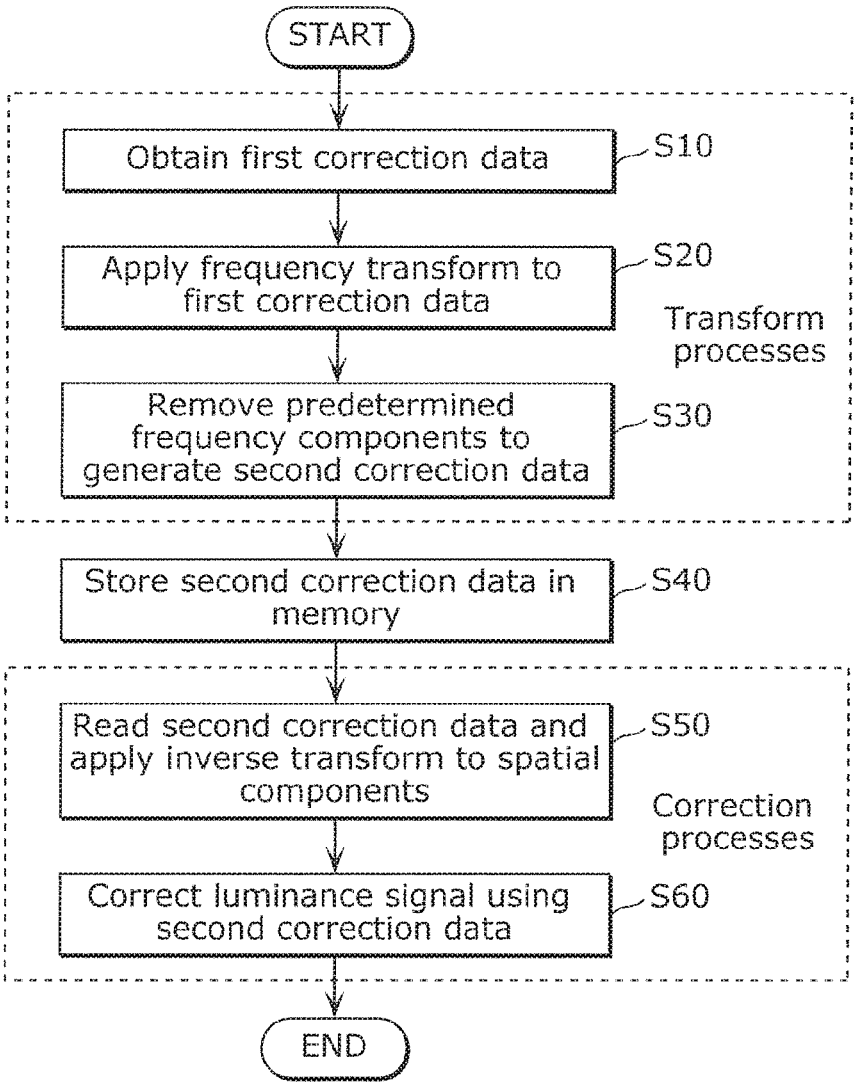
FIG. 6 is an operational flow chart illustrating the correction method used by the display device according to Embodiment 1.

FIG. 6 is an operational flow chart illustrating the correction method performed by the display device 1 according to Embodiment 1. FIG. 6 illustrates steps up to the correction of the luminance signal using the second correction data by the controller 10 included in the display device 1. Hereinafter, the correction steps will be described with reference to FIG. 6.

First, the controller 10 obtains, in advance, the first correction data (unprocessed correction data) for correcting the luminance signal for causing the organic EL elements 401 to emit light at a predetermined luminance (S10; obtaining step). As previously described, the first correction data (unprocessed correction data) includes, for example, two correction parameters: a gain correction value and an offset correction value, which correspond to a sub pixel 400.

Next, an example of the method of obtaining the first correction parameters will be given.

Figure 7:
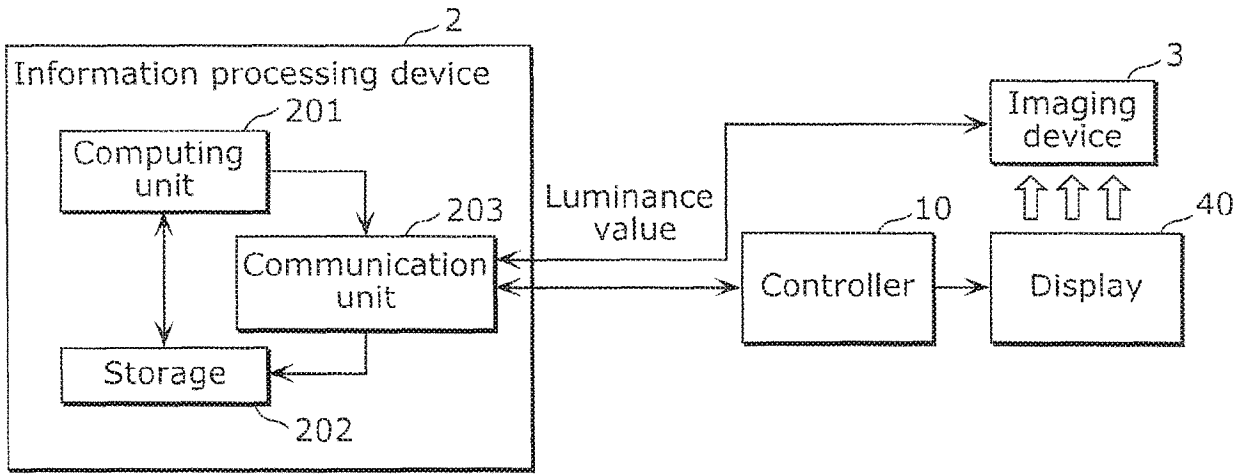
FIG. 7 is a block diagram of a measurement system for obtaining the first correction data.

FIG. 7 is a block diagram of a measurement system for obtaining the first correction data. The measurement system illustrated in FIG. 7 includes an information processing device 2, an imaging device 3, the display 40, and the controller 10.

The information processing device 2 includes a computing unit 201, storage 202, and a communication unit 203, and has a function of controlling the steps performed up until the generation of the first correction parameters. For example, a personal computer is used as the information processing device 2.

Based on a control signal from the communication unit 203, the imaging device 3 images the display 40 and outputs the imaged image data to the communication unit 203. For example, a CCD camera or luminance meter is used as the imaging device 3.

The information processing device 2 outputs a control signal to the controller 10 and the imaging device 3 in the display device 1 to the communication unit 203, obtains measurement data from the controller 10 and the imaging device 3 and stores the measurement data in the storage 202, and calculates, using the computing unit 201, various characteristic values and parameters based on the stored measurement data. Note that a control circuit not included in the display device 1 may be used as the controller 10.

More specifically, the information processing device 2 may control the voltage value to be applied to a measurement sub pixel. The controller 10 applies the voltage value to the measurement sub pixel to cause the measurement sub pixel to emit light. The imaging device 3 measures the luminance value of the measurement sub pixel emitting light. The information processing device 2 receives the voltage value and the measured luminance value. The information processing device 2 changes the voltage value to be applied to a measurement sub pixel and performs the control again to receive a different voltage value and a measured luminance value corresponding to the different voltage value. As a result of the information processing device 2 repeating these processes, the computing unit 201 calculates voltage-luminance characteristics for each measurement sub pixel, and compares these voltage-luminance characteristics against a reference voltage-luminance characteristic to calculate correction parameters (a gain correction value and an offset correction value) for each measurement sub pixel.

The controller 10 receives, as the first correction data via the communication unit 203, the above-described correction parameters calculated by the computing unit 201.

With the steps described above, the controller 10 obtains, in advance, the first correction data for correcting a luminance signal.

Next, the controller 10 deconstructs the first correction data of spatial components into frequency components (S20).

Next, the controller 10 transforms the first correction data into the second correction data removed of predetermined high frequency components (S30). Here, the controller 10 transforms the first correction data into the second correction data by removing high frequency components such that the cutoff frequency for the high frequency components in the blue correction data is lower than the cutoff frequency for the high frequency components in the red correction data, and the cutoff frequency for the high frequency components in the red correction data is lower than the cutoff frequency for the high frequency components in the green correction data. Steps S20 and S30 are transformation steps performed by the transform unit 12 of the controller 10.

Next, the controller 10 stores, in advance, the second correction data in the memory 11 included in the display device 1 (S40; storing step).

Next, the controller 10 reads the second correction data from the memory 11 and inverse transforms the frequency components to spatial components (S50).

Next, the controller 10 corrects the luminance signal using the second correction data of spatial components (S60; correction step).

With the above-described correction method performed by the display device 1 according to this embodiment, the luminance signal is not corrected by the first correction data (unprocessed correction data), but rather by the second correction data removed of predetermined high frequency components. Moreover, the memory 11 stores the second correction data generated as a result of the first correction data being transformed. The second correction data is generated by removing predetermined high frequency components from the first correction data, and is therefore smaller in data size than the first correction data. This yields an advantageous effect in which the capacity of the memory 11 that stores the smaller second correction data can be reduced in accordance with an increase in the resolution of the display 40. This therefore makes it possible to maintain the luminance correction precision and reduce correction data size.

Note that in step S20, the controller 10 may apply a discrete cosine transform to the first correction data of spatial components to remove the high frequency components. This makes it possible to efficiently remove only specific frequency components in the subsequent step S30.

Embodiment 2

In Embodiment 1, a correction method performed by the display device 1 in which the first correction data is obtained, the second correction data is generated from the first correction data, and the luminance signal is corrected using the second correction data was described. In contrast, in this embodiment, a manufacturing method for the display device 1 in which the second correction data is generated from the first correction data and the second correction data is stored in the memory 11 of the display device 1 will be described. In other words, the manufacturing method for the display device 1 according to this embodiment differs from the correction method performed by the display device 1 according to Embodiment 1, which includes steps up to the correction of the luminance signal using the second correction data, in that it includes steps up to the storing of the second correction data into the memory 11. In the following description, configurations that are the same as in display device 1 according to Embodiment 1 and the correction method performed thereby will be omitted. The description will focus on the points of difference.

(2.1 Information Processing Device Configuration in Manufacturing Steps)

Figure 8:
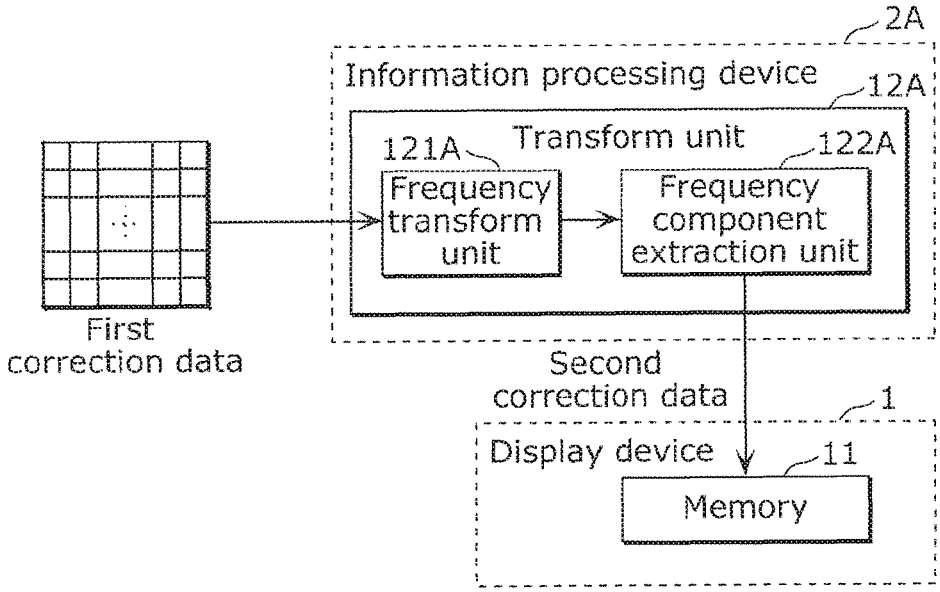
FIG. 8 is a block diagram illustrating the configuration of an information processing device for obtaining the second correction data in a manufacturing step according to Embodiment 2.

FIG. 8 is a block diagram illustrating the configuration of an information processing device 2A for obtaining the second correction data in a manufacturing step. The information processing device 2A illustrated in FIG. 8 is a device used in a manufacturing step for the display device 1, and includes a transform unit 12A.

The transform unit 12A includes a frequency transform unit 121A and a frequency component extraction unit 122A, and deconstructs the unprocessed correction data (first correction data) into frequency components, and transforms the first correction data deconstructed into frequency components into second correction data removed of predetermined high frequency components.

The frequency transform unit 121A deconstructs the first correction data of spatial components into frequency components.

The frequency component extraction unit 122A removes, from the correction data transformed into frequency components by the frequency transform unit 121A, predetermined high frequency components. Here, the frequency component extraction unit 122A removes the high frequency components from the red correction data, the green correction data, and the blue correction data such that more high frequency components are removed for colors having a lower luminosity factor. This method of removing high frequency components is performed based on the attribute that humans comparatively recognize changes in luminance of colors having a relatively lower luminosity factor less than changes in luminance of colors having a relatively higher luminosity factor. Typically, the luminosity factor of blue is lower than the luminosity factor of red, and the luminosity factor of red is lower than the luminosity factor of green. Accordingly, the frequency component extraction unit 122A removes high frequency components such that the cutoff frequency for the high frequency components in the blue correction data is lower than the cutoff frequency for the high frequency components in the red correction data, and the cutoff frequency for the high frequency components in the red correction data is lower than the cutoff frequency for the high frequency components in the green correction data. As a result of the frequency component extraction unit 122A removing only the high frequency components from the frequency components included in the correction data, correction data components that correct variations in luminance in units of one sub pixel to a plurality of sub pixels can be omitted. In this case, the frequency component extraction unit 122A includes the function of a low pass filter (a filter that removes signals of high frequencies), thereby making it possible to generate second correction data removed of only high frequency components.

Note that the first correction data may be obtained by the information processing device 2 according to Embodiment 1 illustrated in FIG. 7. Here, the information processing device 2 according to Embodiment 1 and the information processing device 2A according to this embodiment may be a single device that includes both functions. In other words, the information processing device 2A according to this embodiment may include, in addition to the transform unit 12A, the computing unit 201, the storage 202, and the communication unit 203. Moreover, the first correction data may be applied in advance to the information processing device 2A.

(2.2 Display Device Manufacturing Method)

Figure 9:
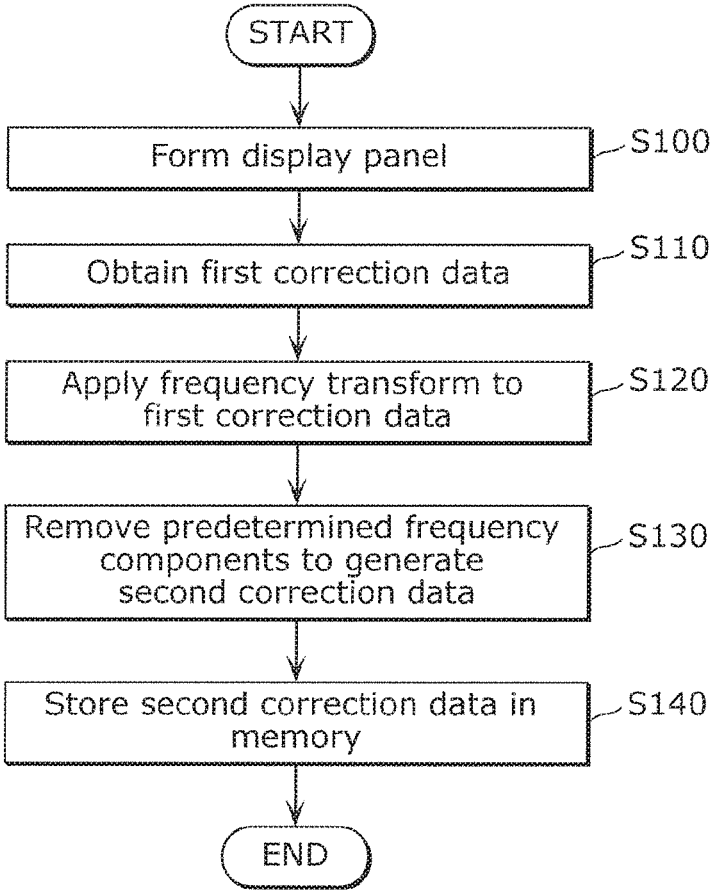
FIG. 9 is an operational flow chart illustrating the manufacturing method for the display device according to Embodiment 2.

FIG. 9 is an operational flow chart illustrating the manufacturing method for the display device 1 according to Embodiment 2. In FIG. 9, steps from the forming of the display panel included in the display device 1 to the storing of the second correction data in the memory are illustrated. Hereinafter, the manufacturing steps will be described with reference to FIG. 9.

First, the display panel included in the display device 1 is formed (S100; forming step). Hereinafter, an example of a display panel forming step will be given. For example, a planarizing film made of an organic, electrically insulating material, is formed on a substrate including circuit components such as a TFT, and then an anode is formed on the planarizing film. Next, for example, a hole-injection layer is formed on the anode. Next, a light emitting layer is formed on the hole-injection layer. Next, an electron-injection layer is formed on the light emitting layer. Next, a cathode is formed on the substrate on which the electron-injection layer is formed. With these steps, an organic EL element having the function of a light emitting element is formed. Furthermore, a thin film sealing layer is formed on the cathode. Next, a sealant resin layer is formed on the surface of the thin film sealing layer. Then, a color filter is formed on the applied sealant resin layer. Next, an adhesive layer and a transparent substrate are arranged on the color filter. Note that the thing film sealing layer, the sealant resin layer, the adhesive layer, and the transparent substrate collectively correspond to the protective layer. Lastly, the sealant resin layer is hardened by compressing the transparent substrate from the top surface downward and applying heat or by applying an energy line, and the transparent substrate, the adhesive layer, the color filter, and the thin film sealing layer are adhered together. The display panel is formed by these forming steps.

Next, the information processing device 2A obtains, in advance, the first correction data (unprocessed correction data) for correcting the luminance signal for causing the organic EL elements 401 to emit light at a predetermined luminance (S110; obtaining step). As previously described, the first correction data (unprocessed correction data) includes, for example, two correction parameters: a gain correction value and an offset correction value, which correspond to a sub pixel 400. The first correction parameters may be obtained by the information processing device 2 according to Embodiment 1 illustrated in FIG. 7, and, alternatively, may be obtained by using the first correction parameters from a display panel manufactured in the same batch, for example.

Next, the information processing device 2A deconstructs the first correction data of spatial components into frequency components (S120).

Next, the information processing device 2A transforms the first correction data into the second correction data removed of predetermined high frequency components (S130). Here, the information processing device 2A transforms the first correction data to the second correction data by removing high frequency components such that the cutoff frequency for the high frequency components in the blue correction data is lower than the cutoff frequency for the high frequency components in the red correction data, and the cutoff frequency for the high frequency components in the red correction data is lower than the cutoff frequency for the high frequency components in the green correction data. Steps S120 and S130 are transformation steps performed by the transform unit 12A of the information processing device 2A.

Next, the information processing device 2A stores the second correction data in the memory 11 included in the display device 1 (S140; storing step).

With the above-described manufacturing method for the display device 1 according to this embodiment, the first correction data (unprocessed correction data) is not stored in the memory 11, but rather the second correction data removed of the predetermined high frequency components is stored in the memory 11. The second correction data is generated by removing predetermined high frequency components from the first correction data, and is therefore smaller in data size than the first correction data. This yields an advantageous effect in which the capacity of the memory 11 that stores the smaller second correction data can be reduced in accordance with an increase in the resolution of the display 40. This therefore makes it possible to maintain the luminance correction precision and reduce correction data size.

Note that in step S120, the information processing device 2A may apply a discrete cosine transform to the first correction data of spatial components to remove the high frequency components. This makes it possible to efficiently remove only specific frequency components in the subsequent step S130.

Moreover, the information processing device 2A may include therein the controller 10 that is included in the display device 1, and in a manufacturing process, the controller 10 may obtain the second correction data and store the second correction data in the memory 11.

Embodiment 3

In Embodiment 1, a correction method performed by the display device 1 in which the first correction data is obtained, the second correction data is generated from the first correction data, and the luminance signal is corrected using the second correction data was described. In contrast, in this embodiment, a display method for the display device 1 including reading the second correction data, correcting the luminance signal using the second correction data, and displaying an image based on the corrected luminance signal will be described. In other words, the manufacturing method for the display device 1 according to this embodiment differs from the manufacturing method for the display device 1 according to Embodiment 2, which includes steps up to the storing of the second correction data into the memory 11, in that it includes steps from the reading of the stored second correction data to the displaying of a pixel. In the following description, configurations that are the same as in display device 1 according to Embodiment 1 and the correction method performed thereby will be omitted. The description will focus on the points of difference.

(3.1 Controller Configuration)

Figure 10:
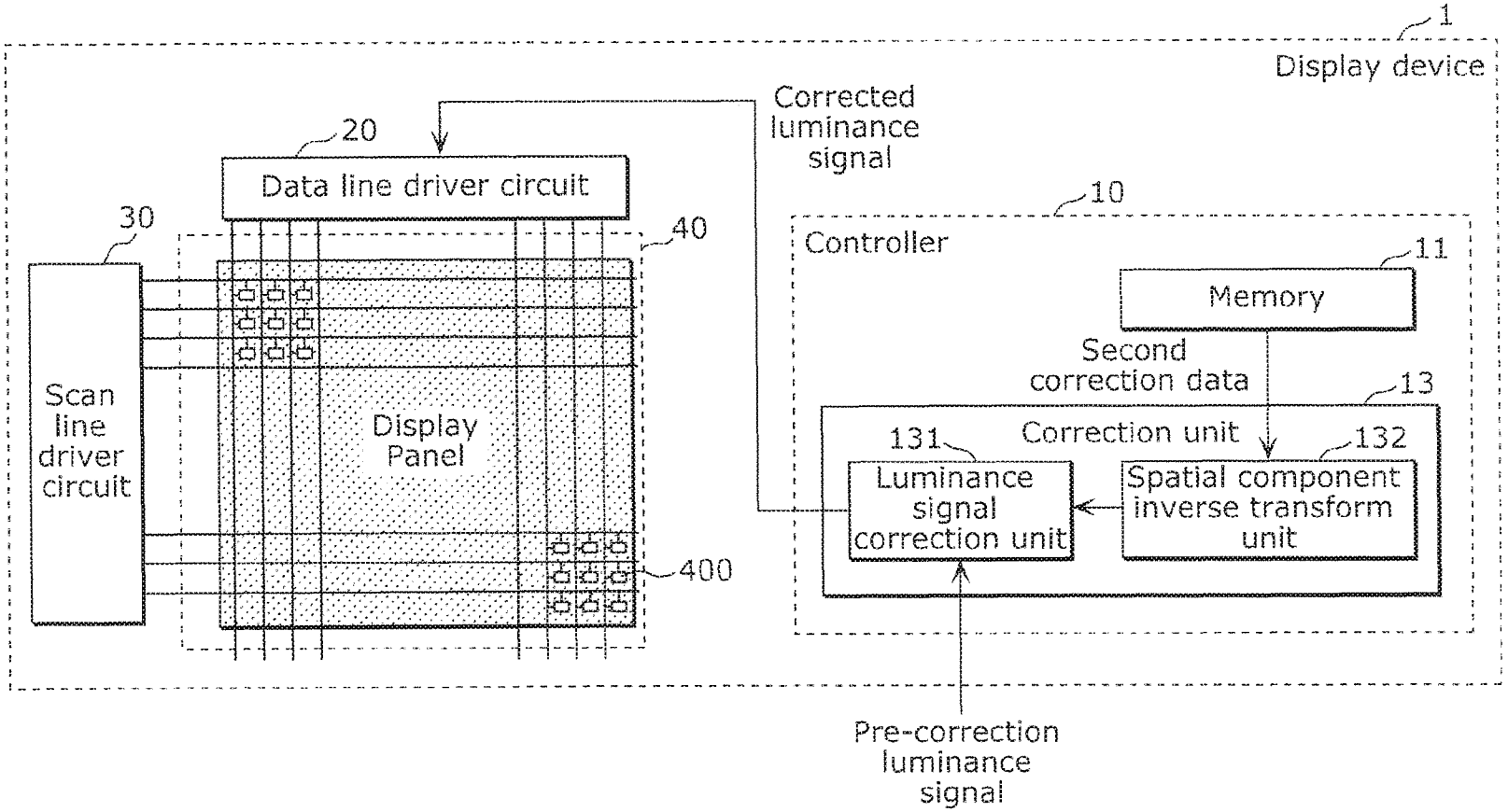
FIG. 10 is a block diagram illustrating a configuration of the controller that causes the display device to display an image using the second correction data according to Embodiment 3.

FIG. 10 is a block diagram illustrating a configuration of the controller 10 that causes the display device 1 to display an image using the second correction data. The controller 10 illustrated in FIG. 10 includes the memory 11 and the correction unit 13.

The correction unit 13 uses the second correction data to correct the luminance signal. The luminance signal is an electric signal for causing light emitting elements in pixels to emit light, and is applied to the pixels. More specifically, in this embodiment, the luminance signal is data voltage applied from the data line driver circuit 20 to the gate of the driver transistor 402 in order to cause the organic EL element 401 included in the sub pixel 400 to emit light.

Here, with the display method according to this embodiment, the luminance signal is not corrected by the above-described first correction data (unprocessed correction data), but rather by processed correction data (second correction data) obtained by processing the unprocessed correction data (first correction data) so as to reduce its data size. The second correction data is generated by removing predetermined high frequency components from the first correction data, and is therefore smaller in data size than the first correction data.

This yields an advantageous effect in which the capacity of the memory 11 that stores the second correction data, which is smaller in data size than the first correction data, can be reduced in accordance with an increase in the resolution of the display 40. Since there is no need to have an excessively large capacity and long lifespan for the storage medium, for example, non-volatile memory, such as flash memory, can be used as the memory 11.

The correction unit 13 includes the spatial component inverse transform unit 132 and the luminance signal correction unit 131.

The spatial component inverse transform unit 132 includes, for example, first memory that is volatile, such as DRAM, and an operation circuit. The spatial component inverse transform unit 132 reads second correction parameters from the memory 11 and temporarily stores them in the first memory. The operation circuit then applies an inverse transform to the second correction data represented in frequency components to yield spatial components.

The luminance signal correction unit 131 corrects the luminance signal corresponding to a sub pixel 400 using the second correction data represented in spatial components generated by the spatial component inverse transform unit 132. Hereinafter, one example of the processes for correcting the luminance signal in the luminance signal correction unit 131 will be given.

The luminance signal correction unit 131 multiplies (or divides) data voltage corresponding to the pre-correction luminance signal by the gain correction value among the second correction parameters represented in spatial components, and adds (or subtracts) the offset correction value among the second correction parameters to (or from) the multiplication value, and outputs the result to the data line driver circuit 20. This makes it possible to maintain the precision of the luminance correction and reduce the correction data size.

(3.2 Display Device Display Method)

Figure 11:
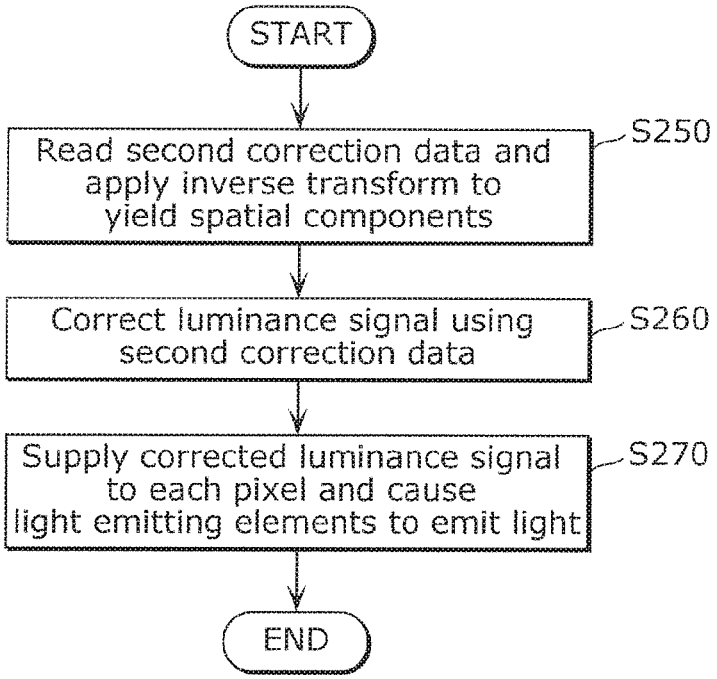
FIG. 11 is an operational flow chart illustrating the display method for the display device according to Embodiment 3.

FIG. 11 is an operational flow chart illustrating the display method for the display device 1 according to Embodiment 3. FIG. 11 illustrates steps performed by the controller 10 included in the display device 1, from reading the second correction data to correcting the luminance signal and displaying an image. Hereinafter, the correction steps will be described with reference to FIG. 11.

First, the controller 10 reads the second correction data from the memory 11 and inverse transforms the frequency components to spatial components (S250).

Next, the controller 10 corrects the luminance signal using the second correction data of spatial components (S260; correction step).

Lastly, the controller 10 supplies the luminance signal corrected in the above corrected step to each sub pixel 400, and causes the display device 1 to display an image by causing the organic EL elements 401 to emit light in accordance with the luminance signal (S270; display step).

With the above-described display method for the display device 1 according to this embodiment, the luminance signal is not corrected by the first correction data (unprocessed correction data), but rather by the second correction data removed of predetermined high frequency components. Moreover, the memory 11 stores the second correction data generated as a result of the first correction data being transformed. The second correction data is generated by removing predetermined high frequency components from the first correction data, and is therefore smaller in data size than the first correction data. This yields an advantageous effect in which the capacity of the memory 11 that stores the smaller second correction data can be reduced in accordance with an increase in the resolution of the display 40. This therefore makes it possible to maintain the luminance correction precision and reduce correction data size.

Embodiment 4

In Embodiment 1, a configuration of display device 1 was described in which the first correction data is deconstructed into frequency components and the first correction data is transformed into the second correction data by removing predetermined high frequency components from the first correction data deconstructed into frequency components. In contrast, in this embodiment, a configuration of the display device will be described in which the sub pixel correction data components included in the first correction data are reconstructed by propagating error components of the sub pixel correction data components included in the first correction data to neighboring sub pixels and reducing the bits of the reconstructed correction data components of the first correction data to transform the first correction data into the second correction data.

This display device has some functions that are different from the display device 1 according to Embodiment 1. Accordingly, the description here will focus on the points of difference.

(4.1 Display Device Configuration)

Figure 12:
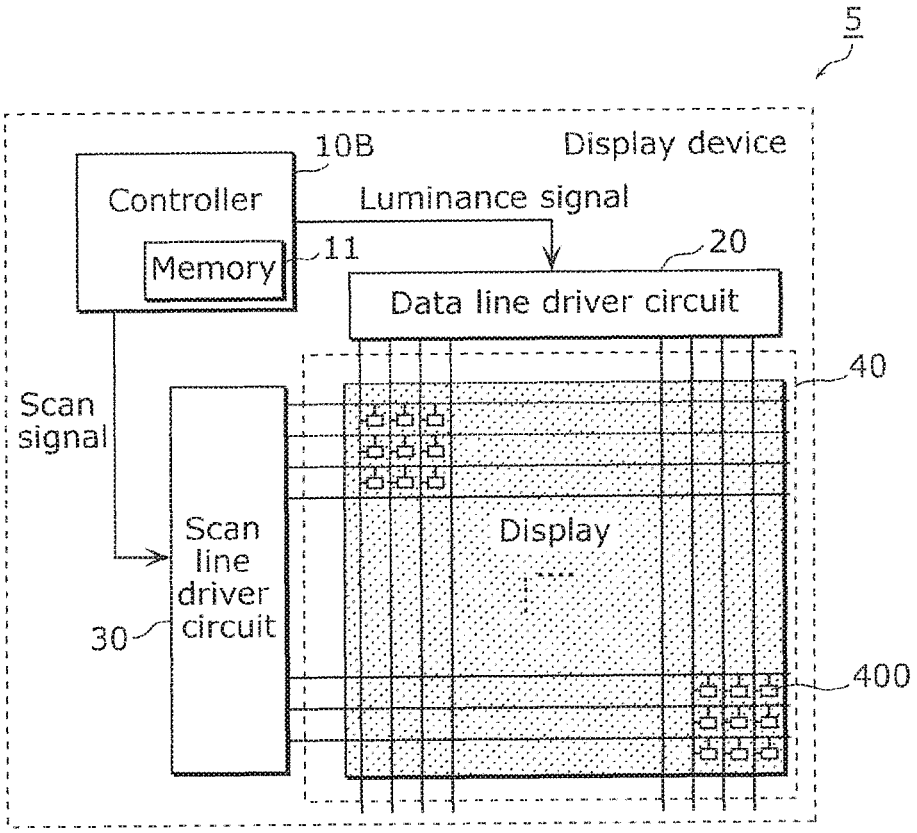
FIG. 12 is a block diagram illustrating a configuration of the display device according to Embodiment 4.

FIG. 12 is a block diagram illustrating a configuration of the display device 5 according to Embodiment 4.

As illustrated in FIG. 12, the display device 5 includes a controller 10B whereas the display device 1 according to Embodiment 1 includes the controller 10.

The controller 10B controls the memory 11, the data line driver circuit 20, and the scan line driver circuit 30.

When the display is operating, the controller 10B reads the second correction data written to the memory 11, and based on the second correction data, corrects a video signal (luminance signal) input from an external source and outputs the corrected signal to the data line driver circuit 20.

Moreover, when, for example, unprocessed correction data (first correction data; to be described later) is generated during manufacturing, the controller 10B, for example, communicates with an external information processing device, and drives the data line driver circuit 20 and the scan line driver circuit 30 in accordance with instruction from the information processing device.

Moreover, for example, the controller 10B applies a transform to unprocessed correction data (first correction data) during manufacturing to generate processed (transformed) correction data (second correction data), and stores the processed correction data in the memory 11.

(4.2 Controller Configuration)

Figure 13:
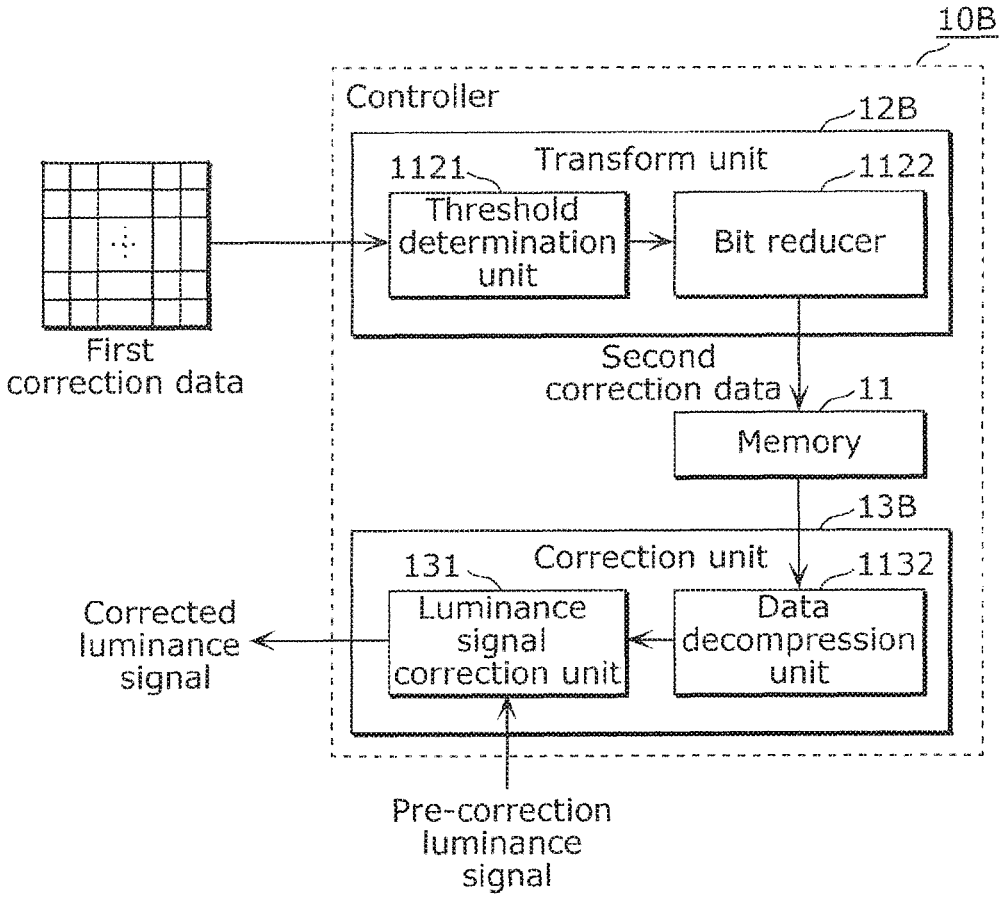
FIG. 13 is a block diagram illustrating a configuration of the controller included in the display device according to Embodiment 4.

FIG. 13 is a block diagram illustrating a configuration of the controller 10B included in the display device 5 according to Embodiment 4.

As illustrated in FIG. 13, the controller 10B includes a transform unit 12B and a correction unit 13B whereas the controller 10 according to Embodiment 1 includes the transform unit 12 and the correction unit 13.

The transform unit 12B transforms unprocessed correction data (first correction data) into second correction data smaller in data size than the first correction data.

The correction unit 13B uses the second correction data to correct the luminance signal. The luminance signal is an electric signal for causing light emitting elements in pixels to emit light, and is applied to the pixels. More specifically, in this embodiment, the luminance signal is data voltage applied from the data line driver circuit 20 to the gate of the driver transistor 402 in order to cause the organic EL element 401 included in the sub pixel 400 to emit light.

The transform unit 12B includes a threshold determination unit 1121 and a bit reducer 1122.

The threshold determination unit 1121 determines a threshold used when the bit reducer 1122 connected down the line reduces bits based on a distribution of the correction data components included in the first correction data. Here, the first correction data includes red correction data for correcting the luminance of red sub pixels, green correction data for correcting the luminance of green sub pixels, and blue correction data for correcting the luminance of blue sub pixels. As such, the threshold determination unit 1121 determines a threshold for each of the red correction data, green correction data, and blue correction data included in the first correction data.

Based on the threshold determined by the threshold determination unit 1121, the bit reducer 1122 quantizes the sub pixel correction data components included in the first correction data, propagates the resulting error components to neighboring sub pixels to reconstruct the sub pixel correction data components included in the first correction data, and reduces the bits of the reconstructed correction data components of the first correction data to generate the second correction data. More specifically, based on the above threshold, the bit reducer 1122 transforms the first correction data into the second correction data by: reconstructing the correction data components corresponding to first sub pixels (one of red sub pixels, green sub pixels, or blue sub pixels) by, for each of the first sub pixels, propagating an error component of the correction data component corresponding to a current first sub pixel to a neighboring first sub pixel, and reducing the reconstructed correction data components corresponding to the first sub pixels by a first number of bits; and reconstructing the correction data components corresponding to second sub pixels (one of red sub pixels, green sub pixels, or blue sub pixels, except for the one that corresponds to the first sub pixels) by, for each of the second sub pixels, propagating an error component of the correction data component corresponding to a current second sub pixel to a neighboring second sub pixel, and reducing the reconstructed correction data components corresponding to the second sub pixels by a second number of bits greater than the first number of bits. Moreover, based on the above-described threshold, the bit reducer 1122 may, with respect to the first correction data, further reconstruct correction data components corresponding to the third sub pixels (one of the red sub pixels, green sub pixels, and blue sub pixels that does not correspond to the first sub pixels or the second sub pixels) by, for each of the third sub pixels, propagating an error component of a correction data component corresponding to a current third sub pixel to a neighboring third sub pixel, and reducing the reconstructed correction data components corresponding to the third sub pixels by a third number of bits greater than the second number of bits.

Here, the bit reducer 1122 reduces the bits of the red correction data, the green correction data, and the blue correction data such that more bits are reduced for colors having lower luminosity factors. This method of bit reduction is performed based on the attribute that humans comparatively recognize changes in luminance of colors having a relatively lower luminosity factor less than changes in luminance of colors having a relatively higher luminosity factor. Typically, the luminosity factor of blue is lower than the luminosity factor of red, and the luminosity factor of red is lower than the luminosity factor of green. Accordingly, the bit reducer 1122 reduces the bits such that the more bits are reduced for the blue correction data than for the red correction data, and more bits are reduced for the red correction data than for the green correction data. In other words, the bit reducer 1122 reduces the bits where the first sub pixel is the green sub pixel, the second sub pixel is the red sub pixel, and the third sub pixel is the blue sub pixel.

For example, an error diffusion method is used as the quantization method of propagating the error components of the sub pixel correction data components included in the first correction data to neighboring sub pixels to reconstruct the sub pixel correction data components included in the first correction data. Other examples of the quantization method include representative dithering methods, such as random dithering and pattern dithering. Using an error diffusing method for the processes performed by bit reducer 1122 makes it possible to maintain the correction precision of the luminance signal.

The correction unit 13B differs from the correction unit 13 according to Embodiment 1 in that it includes a data decompression unit 1132 instead of the spatial component inverse transform unit 132.

The data decompression unit 1132 includes, for example, first memory that is volatile, such as DRAM, and an operation circuit. The data decompression unit 1132 reads the second correction data from the memory 11 and temporarily stores the second correction data in the first memory. Here, second memory—exemplified as SRAM—provided internal (or external) to the first memory stores at least one of the threshold data determined by the threshold determination unit 1121 and discrete values into which the first correction data is quantized. The operation circuit uses at least one of the threshold data and the above-described discrete values stored in the second memory to decompress the second correction data stored in the first memory into correction data (discrete values) having more bits than the second correction data stored in the memory 11. In other words, the correction unit 13B uses at least one of the above-described threshold data and discrete values to decompress the second correction data into data having more bits than the second correction data, and corrects the luminance signal using correction data that is bit-compressed relative to the first correction data. Note the data decompression unit 1132 is not a necessary component of the controller 10B according to this embodiment.

However, the higher the bit reduction factor of the first correction data is in the bit reducer 1122, the lower the correction precision of the second correction data is. Accordingly, when the bit reduction factor is high, the controller 10B preferably includes the data decompression unit 1132.

Next, details regarding the processes performed by the transform unit 12 will be described in detail with reference to FIG. 14.

FIG. 14 illustrates a comparison of correction processes and the results thereof between the display device 5 according to Embodiment 4 and a conventional display device (see FIG. 4 relating to Embodiment 1). The display image on the left in FIG. 14 is one example of an image displayed by the display when a pre-correction luminance signal is used when causing the entire display to emit a uniform luminance. In contrast, the display image in the top right region of FIG. 14 is an image displayed by the display when a luminance signal is corrected by the controller 10B of the display device 5 according to this embodiment. The display image in the bottom right region of FIG. 14 is an image displayed by the display when a luminance signal is corrected by the controller 500 according to the conventional display device.

Moreover, in FIG. 14, the display image corresponding to the display device 5 according to this embodiment is an image corrected using the second correction data generated as a result of the error diffusion and bit reduction processing by the transform unit 12B. The first correction data illustrated in FIG. 14 is represented as, for example, a matrix of gain correction values (correction data components) each of which corresponds to a pixel. The first correction data is error diffused with the display device 5 according to this embodiment. Hereinafter, the correction data in the process of being error diffused in FIG. 14 will be described. Note that for the purpose of illustration, in FIG. 14, the correction data being error diffused is represented as a 4×4 matrix (rows and columns) of correction data components. For example, the position of the upper-left-most correction data component is represented as (1, 1), and the position of the bottom-right-most correction data component is represented as (4, 4).

A detailed example of the first correction data, the correction data being error diffused, the second correction data, and the second correction data (decompressed second correction data) illustrated in FIG. 14 is given in FIG. 15.

The transform unit 12B uses an error diffusion method employing a threshold on the first color correction data (green correction data) for correcting the luminance of the first sub pixel (green sub pixel), the second color correction data (red correction data) for correcting the luminance of the second sub pixel (red sub pixel), and the third color correction data (blue correction data) for correcting the luminance of the third sub pixel (blue sub pixel) included in the first correction data to reduce the number of bits of the first through third color correction data.

Here, as illustrated in FIG. 15, in the correction data being error diffused, each correction data component in the blue correction data has 4 possible values (i.e., are divisible into groups of 2 bits), each correction data component in the red correction data has 8 possible values (i.e., are divisible into groups of 3 bits), and each correction data component in the green correction data has 16 possible values (i.e., are divisible into groups of 4 bits).

In other words, the threshold determination unit 1121 determines a threshold, round-up values, and round-down values for the color correction data included the first correction data such that the blue correction data components are 2 bits giving 4 possible values, the red correction data components are 3 bits giving 8 possible values, and the green correction data components are 4 bits giving 16 possible values. Here, the round-up values and the round-down values are the discrete values into which the first correction data (more specifically, the correction data components included therein) is (are) quantized. The bit reducer 1122 performs error diffusion on the color correction data included in the first correction data using the threshold, round-up values, and round-down values determined by the threshold determination unit 1121, and generates correction data being error diffused and the second correction data. Here, the second correction data generated by the bit reducer 1122 includes 2 bit blue correction data, 3 bit red connection data, and 4 bit green correction data. The bit reducer 1122 then stores the generated second correction data into memory 11.

As described above, as a result of performing error diffusion based on the threshold determined by the threshold determination unit 1121, the bit reducer 1122 quantizes the sub pixel correction data components ((1, 1) through (4, 4)) included in the first correction data, propagates the resulting error components to neighboring sub pixels to reconstruct the sub pixel correction data components included in the first correction data, and reduces the bits of the reconstructed correction data components of the first correction data to generate the second correction data.

In the above example, the bit reducer 1122 reduces the bits of the blue correction data included in the first correction data to 2 bits, reduces the bits of the red correction data included in the first correction data to 3 bits, and reduces the bits of the green correction data included in the first correction data to 4 bits to generate the second correction data.

Next, the data decompression unit 1132 reads the second correction data and temporarily stores it in the first memory, and using a threshold, decompresses the second correction data into correction data (discrete values) having more bits then the second correction data. In other words, the data decompression unit 1132 decompresses the second correction data using the threshold, round-up values, and round-down values determined by the threshold determination unit 1121 to generate (reconstruct) the (decompressed) second correction data—that is to say, the correction data in the process of being error diffused.

Next, a detailed example will be given in which the second correction data is 3-bit data, the thresholds are 0.910, 0.944, 0.978, 1.012, 1.045, 1.079, and 1.113, the discrete values into which the first correction data is quantized are 0.893 ("0"), 0.927 ("1"), 0.961 ("2"), 0.995 ("3"), 1.028 ("4"), 1.062 ("5"), 1.096 ("6"), and 1.130 ("7"). In this case, the data decompression unit 1132 reads and temporarily stores the correction data components of the second correction data quantized into values of "0" through "7" in the first memory, and using only the seven thresholds listed above, can decompress the correction data components of the second correction data into correction data components (discrete values) having more bits (4 or more bits) than the second correction data. For example, when the correction data component (1, 1) of the second correction data is "2", the decompressed correction data component (1, 1) is determined to be a discrete value that falls between the thresholds 0.944 and 0.978, and is calculated to be 0.961 ("2"). Moreover, when the correction data component (1, 2) of the second correction data is "0", the decompressed correction data component (1, 2) is determined to be a discrete value lower than the threshold 0.910, and is calculated to be 0.893 ("0") by the following equation: 0.910−(0.944−0.910)/2 (i.e., half the threshold range is subtracted from 0.910).

Moreover, the data decompression unit 1132 reads and temporarily stores the correction data components of the second correction data quantized into values of "0" through "7" in the first memory, and using only the seven discrete values listed above, can decompress the correction data components of the second correction data into correction data components (discrete values) having more bits (4 or more bits) than the second correction data. For example, when the correction data component (1, 1) of the second correction data is "1", the decompressed correction data component (1, 1) is calculated as the second largest 0.927 ("1"). Moreover, when the correction data component (1, 2) of the second correction data is "5", the decompressed correction data component (1, 2) is calculated as the sixth largest 1.062 ("5").

Moreover, the data decompression unit 1132 reads and temporarily stores the correction data components of the second correction data quantized into values of "0" through "7" in the first memory, and using only the highest and the lowest of the seven discrete values listed above, can decompress the correction data components of the second correction data into correction data components (discrete values) having more bits (4 or more bits) than the second correction data. For example, the above-described seven discrete values can be calculated using the highest value, the lowest value, and the number of bits of the second correction data (3 bits). With this, for example, when the correction data component (1, 1) of the second correction data is "1", the decompressed correction data component (1, 1) is calculated as the second largest 0.927 ("1"). Moreover, when the correction data component (1, 2) of the second correction data is "5", the decompressed correction data component (1, 2) is calculated as the sixth largest 1.062 ("5"). Note that when the above-described seven discrete values are calculated using the highest value, the lowest value, and the number of bits of the second correction data (3 bits), the seven discrete values may be calculated so as to be spaced equally, weighted, or randomly arrayed.

As shown by FIG. 14, the displayed display image based on the luminance signal corrected by the controller 10B and the displayed display image based on the luminance signal corrected by the conventional controller 500 both exhibit greatly reduced luminance unevenness compared to the display image based on the pre-correction luminance signal. However, the display image corrected by the controller 10B according to this embodiment and the display image corrected by the conventional controller 500 are different in regard to the number of bits of the correction data. In other words, the bit-reduced second correction data processed by the controller 10B according to this embodiment is smaller in data size than the first correction data used by the conventional controller 500. Thus, with the display device 5 according to this embodiment, even if the number of pixels in the display is increased, the precision of the luminance correction can be maintained and the correction data size and data transfer rate can be reduced.

Note that in the display device 5 according to this embodiment, the transform unit 12B and the correction unit 13B may be realized as integrated circuits (IC) by large scale integration (LSI). Moreover, the method of integration may be a dedicated circuit or a generic processor. A Field Programmable Gate Array (FPGA) or a reconfigurable processor that allows reconfiguration of the connection or configuration of the inner circuit cells of the LSI circuit can be used for the same purpose. Further, if integrated circuit technology that replaces LSI is newly created from advances in or derivations of semiconductor technology, integration of functional blocks using such technology may also be used. Moreover, the transform unit 12B and the correction unit 13B may be realized as a program that executes the above-described encoding and decoding processing, and may be realized as a computer-readable non-transitory recording medium storing such a program. Examples of the computer-readable non-transitory recording medium include flexible disk, hard disk, CD-ROM, MO, DVD, DVD-ROM, DVD-RAM, Blu-Ray™ (BR) disc, and semiconductor memory. It goes without saying that such a program can be distributed via a recordable medium such as a CD-ROM or over a transmission medium such as the internet.

(4.3 Display Device Correction Method)

Next, the correction method performed by the display device 5 according to this embodiment will be described.

Figure 16:
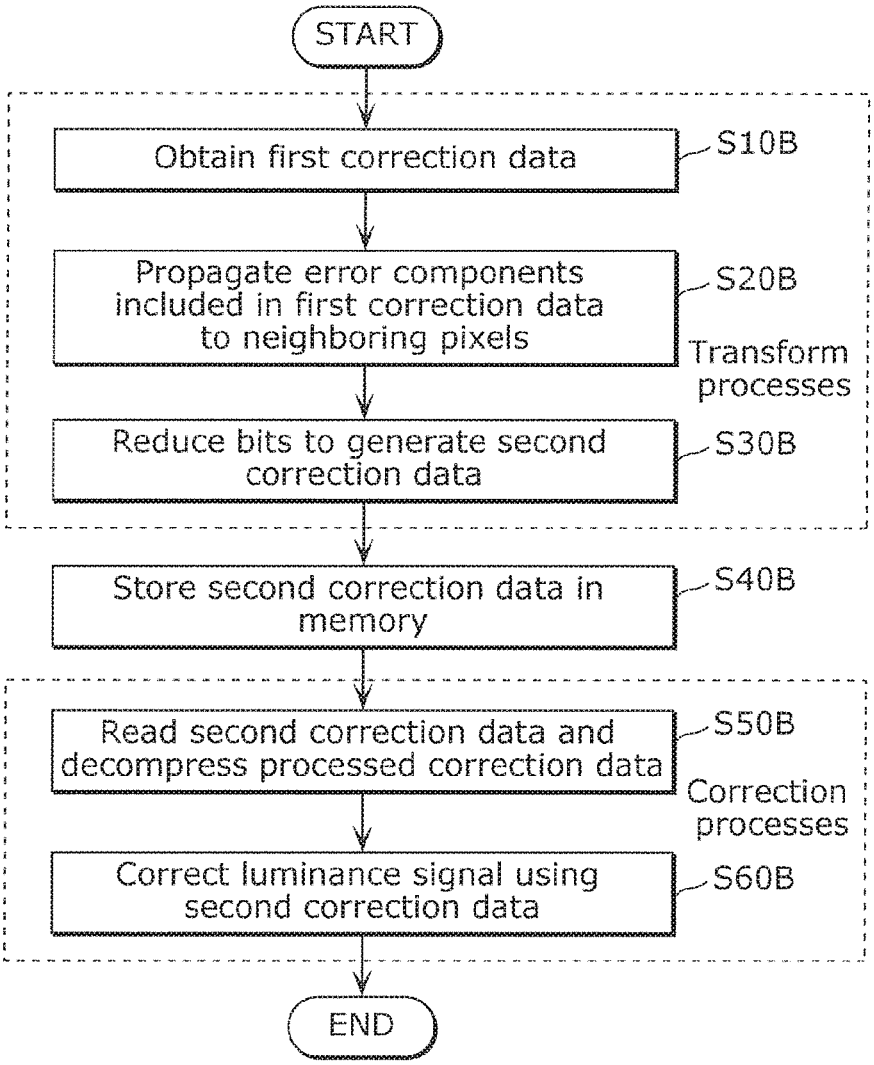
FIG. 16 is an operational flow chart illustrating the correction method used by the display device according to Embodiment 4.

FIG. 16 is an operational flow chart illustrating the correction method performed by the display device 5 according to Embodiment 4.

Hereinafter, the correction steps will be described with reference to FIG. 16.

As illustrated in FIG. 16, the correction method performed by the display device 5 differs from the correction method performed by the display device 1 according to Embodiment 1 (see FIG. 6) in that the step S10 is step S10B, step S20 is step S20B, step S30 is step S30B, step S40 is step S40B, step S50 is step S50B, and step S60 is step S60B.

Here, steps S10B, S40B, S60B are the same as steps S10, S40, and S60 according to Embodiment 1 if display device 1 is read as display device 5 and controller 10 is read as controller 10B. Therefore, the following description will focus on steps S20B, S30B, and S50B.

After completion of step S10, the controller 10B quantizes the correction data components corresponding to the pixels in the first correction data, and reconstructs the correction data components by propagating error components thereof to neighboring pixels (S20B).

Next, the controller 10B reduces the bits of the reconstructed correction data components for the pixels to transform the first correction data into the second correction data (S30B). Steps S20B and S30B are transformation steps performed by the transform unit 12B of the controller 10B.

Next, the controller 10B stores, in advance, the second correction data in the memory 11 included in the display device 5 (S40B; storing step).

Next, the controller 10B reads the second correction data from the memory 11 and using a threshold used as a reference value of the bit reduction performed in step S30B, decompresses the second correction data into correction data having more bits than the second correction data (S50B).

Note that the decompression in step S50B is not a necessary step. However, the higher the bit reduction factor of the first correction data is in step S30B, the lower the correction precision of the second correction data is. Accordingly, when the bit reduction factor is high, the above decompression is preferably performed.

Next, the controller 10B corrects the luminance signal using the second correction data (S60B; correction step).

With the above-described correction method performed by the display device 5 according to this embodiment, the luminance signal is not corrected by the first correction data (unprocessed correction data), but rather by the second correction data processed in steps S20B and S30B. Moreover, the memory 11 stores the second correction data generated as a result of the first correction data being transformed. The second correction data is generated by reducing the bits of the first correction data, and is therefore smaller in data size than the first correction data. This yields an advantageous effect in which the capacity of the memory 11 that stores the smaller second correction data can be reduced in accordance with an increase in the resolution of the display 40. This therefore makes it possible to maintain the luminance correction precision and reduce correction data size and data transfer rate.

Note that in step S20B, an error diffusion method may be used as the method of reconstructing the correction data components corresponding to the pixels in the first correction data by propagating error components thereof to neighboring pixels. Using an error diffusion method makes it possible to maintain the correction precision of the luminance signal. Other than an error diffusion method, a representative dithering method, such as random dithering and pattern dithering, may be applied.

Moreover, upon reconstructing the correction data components corresponding to the pixels in the first correction data by propagating error components thereof to neighboring pixels, the correction data components may be quantized and the correction data components may be reconstructed using the resulting error components based on a threshold determined according to the distribution of the correction data components included in the first correction data.

Moreover, in step S30B, the reconstructed correction data components resulting from propagating error components of the correction data components corresponding to the pixels included in the first correction data to neighboring pixels may be reduced in bits by binarization. In such cases, it is possible to reduce the data size of the second correction data to the greatest extent.

Embodiment 5

In Embodiment 4, a correction method performed by the display device 5 in which the first correction data is obtained, the second correction data is generated from the first correction data, and the luminance signal is corrected using the second correction data was described. In contrast, in this embodiment, a manufacturing method for the display device 5 in which the second correction data is generated from the first correction data and the second correction data is stored in the memory 11 of the display device 5 will be described. In other words, the manufacturing method for the display device 5 according to this embodiment differs from the correction method performed by the display device 5 according to Embodiment 4, which includes steps up to the correction of the luminance signal using the second correction data, in that it includes steps up to the storing of the second correction data into the memory 11. In the following description, configurations that are the same as in display device 5 according to Embodiment 4 and the correction method performed thereby will be omitted. The description will focus on the points of difference.

(5.1 Information Processing Device Configuration in Manufacturing Steps)

Figure 17:
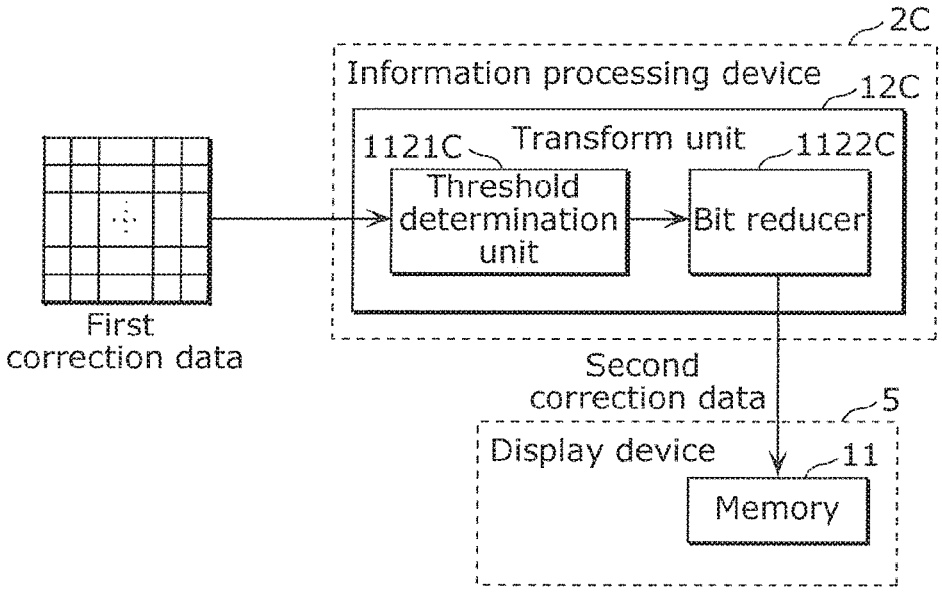
FIG. 17 is a block diagram illustrating the configuration of an information processing device for obtaining the second correction data in a manufacturing step according to Embodiment 5.

FIG. 17 is a block diagram illustrating the configuration of an information processing device 2C for obtaining the second correction data in a manufacturing step. The information processing device 2C illustrated in FIG. 17 is a device used in a manufacturing step for the display device 5, and includes a transform unit 12C.

The transform unit 12C includes a threshold determination unit 1121C and a bit reducer 1122C, and transforms unprocessed correction data (first correction data) into second correction data smaller in data size than the first correction data.

The threshold determination unit 1121C determines a threshold used when the bit reducer 1122C connected down the line reduces bits based on a distribution of the correction data components included in the first correction data. Here, the first correction data includes red correction data for correcting the luminance of red sub pixels, green correction data for correcting the luminance of green sub pixels, and blue correction data for correcting the luminance of blue sub pixels. As such, the threshold determination unit 1121C determines a threshold for each of the red correction data, green correction data, and blue correction data included in the first correction data.

Based on the threshold determined by the threshold determination unit 1121C, the bit reducer 1122C quantizes the sub pixel correction data components included in the first correction data, propagates the resulting error components to neighboring sub pixels to reconstruct the sub pixel correction data components included in the first correction data, and reduces the bits of the reconstructed correction data components of the first correction data to generate the second correction data. More specifically, based on the above threshold, the bit reducer 1122C transforms the first correction data into the second correction data by: reconstructing the correction data components corresponding to first sub pixels (one of red sub pixels, green sub pixels, or blue sub pixels) by, for each of the first sub pixels, propagating an error component of the correction data component corresponding to a current first sub pixel to a neighboring first sub pixel, and reducing the reconstructed correction data components corresponding to the first sub pixels by a first number of bits; and reconstructing the correction data components corresponding to second sub pixels (one of red sub pixels, green sub pixels, or blue sub pixels, except for the one that corresponds to the first sub pixels) by, for each of the second sub pixels, propagating an error component of the correction data component corresponding to a current second sub pixel to a neighboring second sub pixel, and reducing the reconstructed correction data components corresponding to the second sub pixels by a second number of bits greater than the first number of bits. Moreover, based on the above-described threshold, the bit reducer 1122C may, with respect to the first correction data, further reconstruct correction data components corresponding to the third sub pixels (one of the red sub pixels, green sub pixels, and blue sub pixels that does not correspond to the first sub pixels or the second sub pixels) by, for each of the third sub pixels, propagating an error component of a correction data component corresponding to a current third sub pixel to a neighboring third sub pixel, and reducing the reconstructed correction data components corresponding to the third sub pixels by a third number of bits greater than the second number of bits.

Here, the bit reducer 1122C reduces the bits of the red correction data, the green correction data, and the blue correction data such that more bits are reduced for colors having lower luminosity factors. This method of bit reduction is performed based on the attribute that humans comparatively recognize changes in luminance of colors having a relatively lower luminosity factor less than changes in luminance of colors having a relatively higher luminosity factor. Typically, the luminosity factor of blue is lower than the luminosity factor of red, and the luminosity factor of red is lower than the luminosity factor of green. Accordingly, the bit reducer 1122C reduces the bits such that more bits are reduced for the blue correction data than for the red correction data, and more bits are reduced for the red correction data than for the green correction data. In other words, the bit reducer 1122C reduces the bits where the first sub pixel is the green sub pixel, the second sub pixel is the red sub pixel, and the third sub pixel is the blue sub pixel.

For example, an error diffusion method is used as the quantization method of propagating the error components of the sub pixel correction data components included in the first correction data to neighboring sub pixels to reconstruct the sub pixel correction data components included in the first correction data. Other examples of the quantization method include representative dithering methods, such as random dithering and pattern dithering. Using an error diffusing method for the processes performed by bit reducer 1122C makes it possible to maintain the correction precision of the luminance signal.

Note that the first correction data may be obtained by the information processing device 2 according to Embodiment 1 illustrated in FIG. 7. Here, the information processing device 2 according to Embodiment 1 and the information processing device 2C according to this embodiment may be a single device that includes both functions. In other words, the information processing device 2C according to this embodiment may include, in addition to the transform unit 12C, the computing unit 201, the storage 202, and the communication unit 203. Moreover, the first correction data may be applied in advance to the information processing device 2C.

(5.2 Display Device Manufacturing Method)

Figure 18:
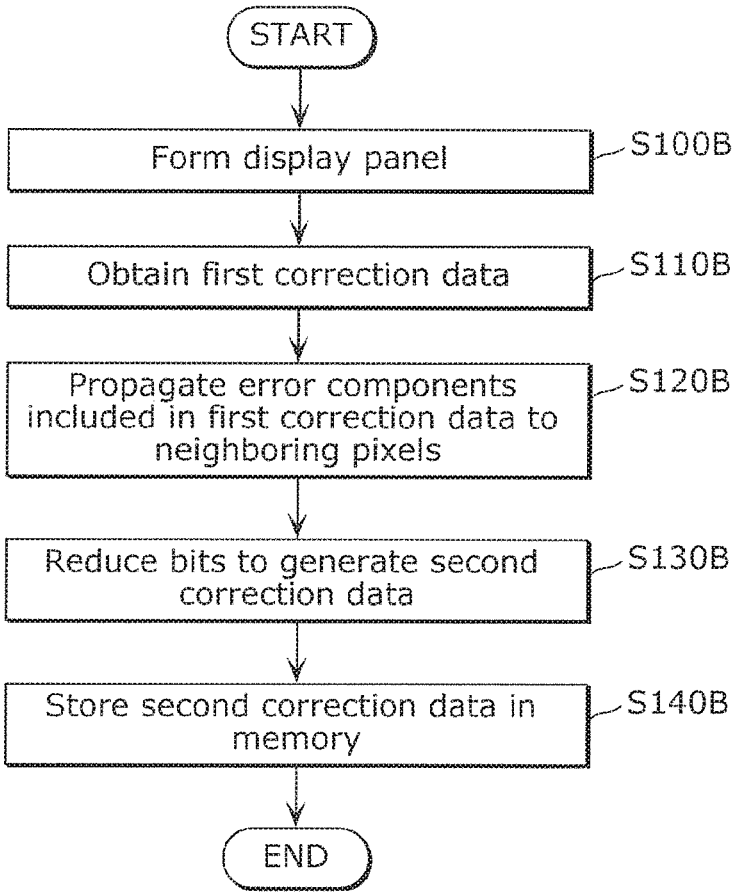
FIG. 18 is an operational flow chart illustrating the manufacturing method for the display device according to Embodiment 5.

FIG. 18 is an operational flow chart illustrating the manufacturing method for the display device 5 according to Embodiment 4. In FIG. 18, steps from the forming of the display panel included in the display device 1 to the storing of the second correction data in the memory are illustrated. Hereinafter, the manufacturing steps will be described with reference to FIG. 18.

As illustrated in FIG. 18, the manufacturing method for the display device 5 differs from the manufacturing method for the display device 1 according to Embodiment 1 (see FIG. 9) in that the step S100 is step S100B, step S110 is step S110B, step S120 is step S120B, step S130 is step S130B, and step S140 is step S140B.

Here, steps S100B, S110B, and S140B are the same as steps S100, S110, and S140 according to Embodiment 1 if display device 1 is read as display device 5 and information processing device 2A is read as information processing device 2C. Therefore, the following description will focus on steps S120B and S130B.

After completion of step S110B, the information processing device 2C quantizes the correction data components corresponding to the pixels in the first correction data, and reconstructs the correction data components by propagating error components thereof to neighboring pixels (S120B).

Next, the information processing device 2C reduces the bits of the reconstructed correction data components for the pixels to transform the first correction data into the second correction data (S1308B). Steps S120B and S130B are transformation steps performed by the transform unit 12C of the information processing device 2C.

Next, the information processing device 2C stores, in advance, the second correction data in the memory 11 included in the display device 5 (S140B; storing step).

With the above-described manufacturing method for the display device 5 according to this embodiment, the first correction data (unprocessed correction data) is not stored in the memory 11, but rather the second correction data processed in steps S120B and S130B is stored in the memory 11. The second correction data is generated by reducing the bits of the first correction data, and is therefore smaller in data size than the first correction data. This yields an advantageous effect in which the capacity of the memory 11 that stores the smaller second correction data can be reduced in accordance with an increase in the resolution of the display 40. This therefore makes it possible to maintain the luminance correction precision and reduce correction data size and data transfer rate.

Note that in step S120B, an error diffusion method may be used as the method of reconstructing the correction data components corresponding to the pixels in the first correction data by propagating error components thereof to neighboring pixels. Using an error diffusion method makes it possible to maintain the correction precision of the luminance signal. Other than an error diffusion method, a representative dithering method, such as random dithering and pattern dithering, may be applied.

Moreover, upon reconstructing the correction data components corresponding to the pixels in the first correction data by propagating error components thereof to neighboring pixels, the correction data components may be quantized and the correction data components may be reconstructed using the resulting error components based on a threshold determined according to the distribution of the correction data components included in the first correction data.

Moreover, the information processing device 2C may include therein the controller 10B that is included in the display device 5, and in a manufacturing process, the controller 10B may obtain the second correction data and store the second correction data in the memory 11.

Embodiment 6

In Embodiment 4, a correction method performed by the display device 5 in which the first correction data is obtained, the second correction data is generated from the first correction data, and the luminance signal is corrected using the second correction data was described. In contrast, in this embodiment, a display method for the display device 5 including reading the second correction data, correcting the luminance signal using the second correction data, and displaying an image based on the corrected luminance signal will be described. In other words, the correction method performed by the display device 5 according to this embodiment differs from the manufacturing method for the display device 5 according to Embodiment 5, which includes steps up to the storing of the second correction data into the memory 11, in that it includes steps from the reading of the stored second correction data to the displaying of an image. In the following description, configurations that are the same as in display device 5 according to Embodiment 4 and the correction method performed thereby will be omitted. The description will focus on the points of difference.

(6.1 Controller Configuration)

Figure 19:
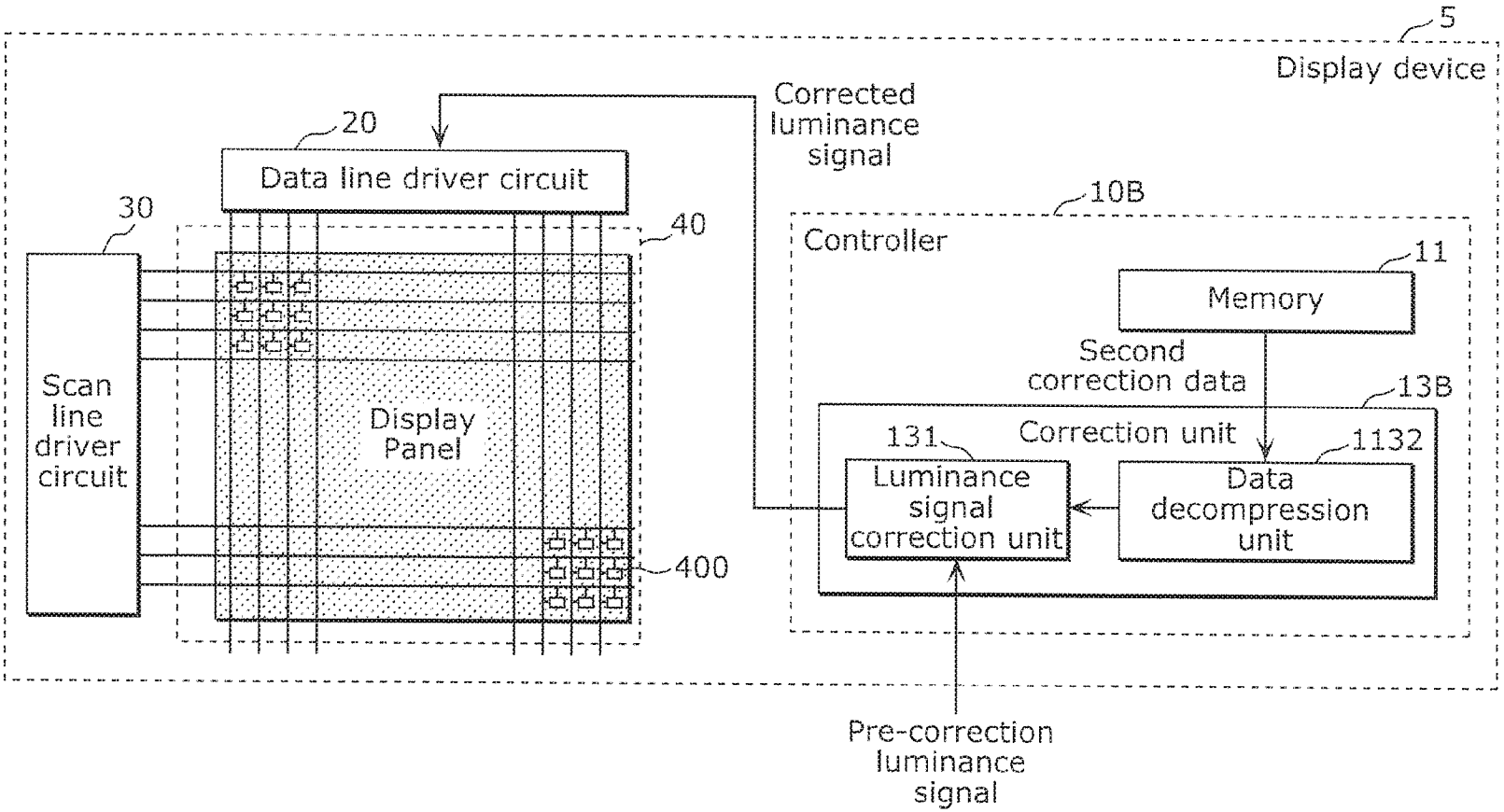
FIG. 19 is a block diagram illustrating a configuration of the controller that causes the display device to display an image using the second correction data according to Embodiment 6.

FIG. 19 is a block diagram illustrating a configuration of the controller 10B that causes the display device 5 to display an image using the second correction data. The controller 10B illustrated in FIG. 19 includes the memory 11 and the correction unit 13B.

The correction unit 13B uses the second correction data to correct the luminance signal. The luminance signal is an electric signal for causing light emitting elements in pixels to emit light, and is applied to the pixels. More specifically, in this embodiment, the luminance signal is data voltage applied from the data line driver circuit 20 to the gate of the driver transistor 402 in order to cause the organic EL element 401 included in the sub pixel 400 to emit light.

Here, with the display method according to this embodiment, the luminance signal is not corrected by the above-described first correction data (unprocessed correction data), but rather by processed correction data (second correction data) obtained by processing the unprocessed correction data (first correction data) so as to reduce its data size. The second correction data is generated by reducing the bits of the first correction data, and is therefore smaller in data size than the first correction data.

This yields an advantageous effect in which the capacity of the memory 11 that stores the second correction data, which is smaller in data size than the first correction data, can be reduced in accordance with an increase in the resolution of the display 40. Since there is no need to have an excessively large capacity and long lifespan for the storage medium, for example, non-volatile memory, such as flash memory, can be used as the memory 11.

The correction unit 13B includes the data decompression unit 1132 and the luminance signal correction unit 131.

The data decompression unit 1132 includes, for example, first memory that is volatile, such as DRAM, and an operation circuit. The data decompression unit 1132 reads the second correction data from the memory 11 and temporarily stores the second correction data in the first memory. Here, second memory—exemplified as SRAM—provided internal (or external) to the first memory stores at least one of the threshold data determined by the threshold determination unit 1121 and discrete values into which the first correction data is quantized. The operation circuit uses at least one of the threshold data and the above-described discrete values stored in the second memory to decompress the second correction data stored in the first memory into correction data (discrete values) having more bits than the second correction data stored in the memory 11. In other words, the correction unit 13B uses at least one of the above-described threshold data and discrete values to decompress the second correction data into data having more bits than the second correction data, and corrects the luminance signal using correction data that is bit-compressed relative to the first correction data. Note the data decompression unit 1132 is not a necessary component of the controller 10B according to this embodiment.

However, the higher the bit reduction factor of the first correction data is, the lower the correction precision of the second correction data is. Accordingly, when the bit reduction factor is high, the controller 10B preferably includes the data decompression unit 1132.

The luminance signal correction unit 131 corrects the luminance signal corresponding to a sub pixel 400 using the second correction data decompressed by the data decompression unit 1132. Hereinafter, one example of the processes for correcting the luminance signal in the luminance signal correction unit 131 will be given.

The luminance signal correction unit 131 multiplies (or divides) data voltage corresponding to the pre-correction luminance signal by the gain correction value among the second correction data (gain correction value and offset correction value), and adds (or subtracts) the offset correction value to (or from) the multiplication value, and outputs the result to the data line driver circuit 20. This therefore makes it possible to maintain the luminance correction precision and reduce correction data size and data transfer rate.

(6.2 Display Device Display Method)

Figure 20:
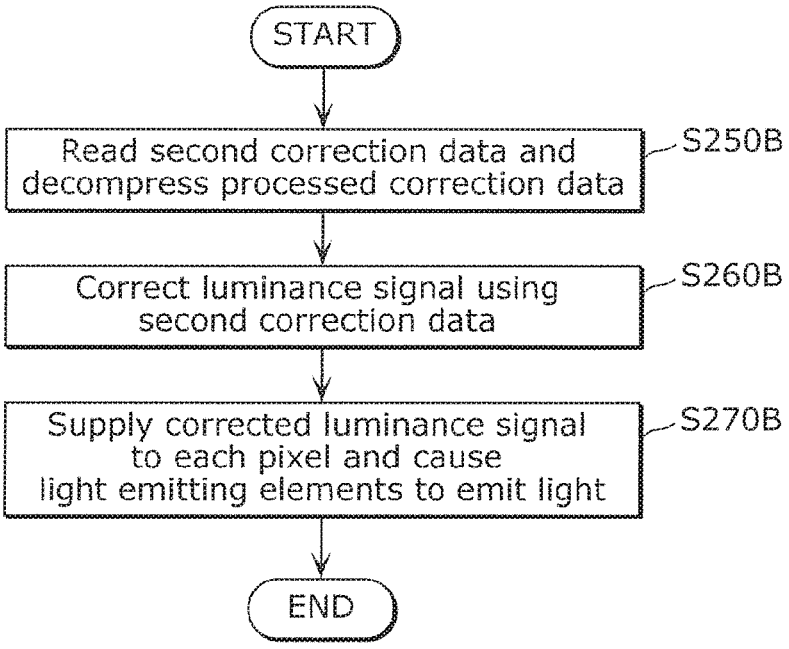
FIG. 20 is an operational flow chart illustrating the display method for the display device according to Embodiment 6.

FIG. 20 is an operational flow chart illustrating the display method for the display device 5 according to Embodiment 6. FIG. 20 illustrates steps performed by the controller 10B included in the display device 5, from reading the second correction data to correcting the luminance signal and displaying an image. Hereinafter, the correction steps will be described with reference to FIG. 20.

First, the controller 10B reads the second correction data from the memory 11 and using at least one of a threshold used as a reference value of the bit reduction and the discrete values into which the first correction data is quantized, decompresses the second correction data into correction data having more bits than the second correction data (S250B).

Note that the decompression in step S250B is not a necessary step. However, the higher the bit reduction factor of the first correction data is, the lower the correction precision of the second correction data is. Accordingly, when the bit reduction factor is high, the above decompression is preferably performed.

Next, the controller 10B corrects the luminance signal using the second correction data (S260B; correction step).

Lastly, the controller 10B supplies the luminance signal corrected in the above corrected step to each sub pixel 400, and causes the display device 5 to display an image by causing the organic EL elements 401 to emit light in accordance with the luminance signal (S270B; display step).

With the above-described display method for the display device 5 according to this embodiment, the luminance signal is not corrected by the first correction data (unprocessed correction data), but rather by the bit-reduced second correction data. Moreover, the memory 11 stores the second correction data generated as a result of the first correction data being transformed. The second correction data is generated by reducing the bits of the first correction data, and is therefore smaller in data size than the first correction data. This yields an advantageous effect in which the capacity of the memory 11 that stores the smaller second correction data can be reduced in accordance with an increase in the resolution of the display 40. This therefore makes it possible to maintain the luminance correction precision and reduce correction data size and data transfer rate.

Other Embodiments

The display device, the correction method for the display device, the manufacturing method for the display device, and the display method for the display device have been described based on, but are not limited to, the exemplary Embodiments 1 through 6. Those skilled in the art will readily appreciate that many modifications are possible in the exemplary embodiments without materially departing from the inventive scope. Accordingly, all such modifications, including any device including the display device according to the present disclosure are intended to be included within the scope thereof.

Figure 21:
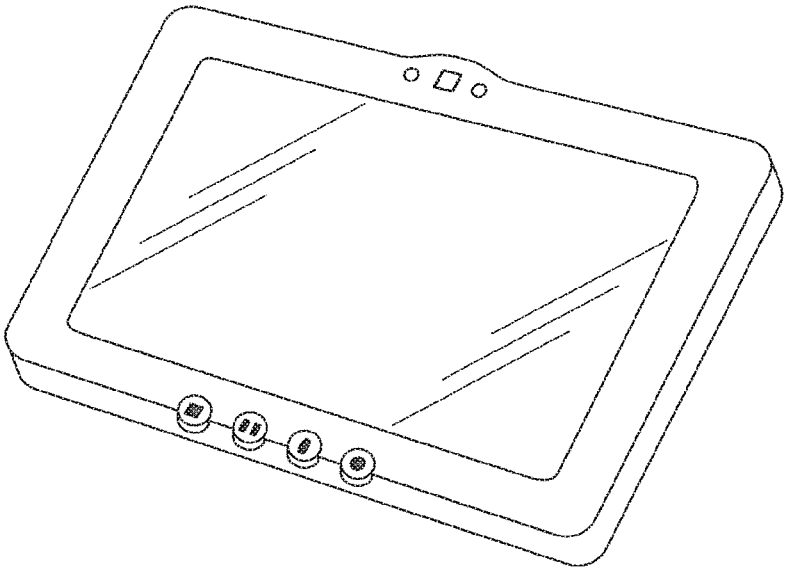
FIG. 21 is an external view of a tablet terminal internally equipped with the display device according to any one of Embodiments 1 to 6.

For example, the display device, the correction method for the display device, the manufacturing method for the display device, and the display method for the display device according to Embodiments 1 to 6 are applied to a tablet like the one illustrated in FIG. 21. Through application of the display device, the correction method for the display device, the manufacturing method for the display device, and the display method for the display device according to the present disclosure, a compact, high-definition, low-cost tablet including a display with reduced luminance unevenness is realized.

Note that in the above embodiments, an image is displayed on the display 40 based on a luminance signal generated based on an external video signal, but this example is not limiting. A luminance signal for causing the pixels to emit light is not limited to being generated from an external video signal; the luminance signal may be generated from various types of signals for displaying still or moving pictures.

Moreover, the first correction data is not limited to being generated during manufacturing of the display device. Moreover, the second correction data is not limited to being stored in the memory 11 generated during manufacturing of the display device. After manufacturing of the display device is complete, while the display device is operating or not operating, the first correction data may be updated and the second correction data may be newly stored based on the updated first correction data.

Moreover, the light emitting elements included in the pixels are not limited to organic EL elements. The light emitting elements may be made of a current-driven or voltage-driven inorganic material.

Moreover, each pixel is exemplified as including red, green, and blue sub pixels which emit light of the three primary colors red, green, and blue, respectively, but the color combination of the sub pixels is not limited to this example so long as a variety of colors can be generated. For example, each pixel may include yellow, magenta, and cyan sub pixels which emit yellow, magenta, and cyan light, respectively.

Further, each pixel may include a combination of four or more sub pixels which emit four or more colors capable of being combined to generate a variety of colors. For example, each pixel may include red, green, blue, and yellow sub pixels which emit red, green, blue, and yellow light, respectively.

Although only some exemplary embodiments of the present disclosure have been described in detail above, those skilled in the art will readily appreciate that many modifications are possible in the exemplary embodiments without materially departing from the novel teachings and advantages of the present disclosure. Accordingly, all such modifications are intended to be included within the scope of the present disclosure.

INDUSTRIAL APPLICABILITY

The present disclosure is applicable to organic EL flat panel displays having a display device including organic EL elements, and is optimal for a compact, high-definition display device in which uniform image quality is desirable, and a correction method therefore.

The invention claimed is:

1. A display device correction method for correcting luminance unevenness in a display device including a matrix of pixels each including a light emitting element that emits light in accordance with a luminance signal, the display device correction method comprising:

obtaining, in advance, first correction data for correcting the luminance signal, the first correction data including correction data components corresponding to the pixels;

removing high frequency components of the first correction data by executing a low-pass filter function;

transforming the first correction data into second correction data smaller in data size than the first correction data; and correcting the luminance signal using the second correction data, wherein the pixels each include at least a first sub pixel that emits light of a first color, a second sub pixel that emits light of a second color, and a third sub pixel that emits light of a third color, the first correction data and the second correction data respectively include at least first color correction data for correcting a luminance of the first sub pixel, second color correction data for correcting a luminance of the second sub pixel, and third color correction data for correcting a luminance of the third sub pixel, and in the transforming, the first correction data is transformed such that a data reduction amount of the second color correction data is greater than a data reduction amount of the first color correction data, wherein the correcting uses a corrector that includes a spatial component inverse transformer that applies an inverse transform to the second correction data represented in low frequency components to yield second correction data represented in spatial components, and a luminance signal corrector that corrects the luminance signal using the second correction data represented in spatial components.

2. The display device correction method according to claim 1, wherein the first color has a luminosity factor that is higher than a luminosity factor of the second color.

3. The display device correction method according to claim 2, wherein the first color is green, the second color is red, the third color is blue, and in the transforming, the first correction data is transformed such that a data reduction amount of the third color correction data is greater than the data reduction amount of the second color correction data.

4. The display device correction method according to claim 1, further comprising:

storing, in advance, the second correction data in memory included in the display device after the transforming, wherein in the correcting, the second correction data stored in the memory is read and used to correct the luminance signal.

5. The display device correction method according to claim 1, wherein, in the transforming, the first correction data is transformed by deconstructing the first color correction data and the second color correction data included in the first correction data into frequency components, removing a high frequency component greater than or equal to a first frequency from the deconstructed first color correction data to generate the first color correction data included in the second correction data, and removing a high frequency component greater than or equal to a second frequency lower than the first frequency from the deconstructed second color correction data to generate the second color correction data included in the second correction data.

6. The display device correction method according to claim 5, wherein, in the transforming, the first correction data is transformed by further deconstructing the third color correction data included in the first correction data into frequency components and removing a high frequency component greater than or equal to a third frequency lower than the second frequency from the deconstructed third color correction data to generate the third color correction data included in the second correction data.

7. The display device correction method according to claim 5, wherein, in the transforming, the first color correction data and the second color correction data are deconstructed into the frequency components using a discrete cosine transform.

8. The display device correction method according to claim 5, wherein, in the correcting, the first color correction data and the second color correction data included in the second correction data are inverse transformed from the frequency components to spatial components and the inverse transformed second correction data is used to correct the luminance signal.

9. The display device correction method according to claim 1, wherein, in the transforming, the first correction data is transformed into the second correction data by reconstructing correction data components corresponding to the first sub pixels by, for each of the first sub pixels, propagating an error component of a correction data component corresponding to a current first sub pixel to a neighboring first sub pixel, and reducing the reconstructed correction data components corresponding to the first sub pixels by a first number of bits; and reconstructing correction data components corresponding to the second sub pixels by, for each of the second sub pixels, propagating an error component of a correction data component corresponding to a current second sub pixel to a neighboring second sub pixel, and reducing the reconstructed correction data components corresponding to the second sub pixels by a second number of bits greater than the first number of bits.

10. The display device correction method according to claim 9, wherein, in the transforming, the first correction data is transformed into the second correction data by further reconstructing correction data components corresponding to the third sub pixels by, for each of the third sub pixels, propagating an error component of a correction data component corresponding to a current third sub pixel to a neighboring third sub pixel, and reducing the reconstructed correction data components corresponding to the third sub pixels by a third number of bits greater than the second number of bits.

11. The display device correction method according to claim 1, wherein, in the transforming, the first correction data is transformed into the second correction data by performing error diffusion on the correction data components of the first correction data and reducing bits of the correction data components on which the error diffusion has been performed.

12. The display device correction method according to claim 11, wherein, in the transforming, the correction data components of the first correction data are propagated to a neighboring pixel based on threshold data derived in advance, and in the correcting, the correction data components of the second correction data are each decompressed into data having more bits than the second correction data by using at least one of the threshold data and discrete values into which the first correction data is quantized, and the luminance signal is corrected using the decompressed second correction data.

13. A display device manufacturing method for manufacturing a display device including a matrix of pixels each including a light emitting element that emits light in accordance with a luminance signal, the display device manufacturing method comprising:

forming a display panel including the pixels;

obtaining, in advance, first correction data for correcting the luminance signal, the first correction data including correction data components corresponding to the pixels;

removing high frequency components of the first correction data by executing a low-pass filter function;

transforming the first correction data into second correction data smaller in data size than the first correction data;

correcting the luminance signal using the second correction data; and storing the second correction data in memory included in the display device after the transforming, wherein the pixels each include at least a first sub pixel that emits light of a first color, a second sub pixel that emits light of a second color, and a third sub pixel that emits light of a third color, the first correction data and the second correction data respectively include at least first color correction data for correcting a luminance of the first sub pixel, second color correction data for correcting a luminance of the second sub pixel, and third color correction data for correcting a luminance of the third sub pixel, in the transforming, the first correction data is transformed such that a data reduction amount of the second color correction data is greater than a data reduction amount of the first color correction data, and in the correcting, a corrector is used that includes a spatial component inverse transformer that applies an inverse transform to the second correction data represented in low frequency components to yield second correction data represented in spatial components, and a luminance signal corrector that corrects the luminance signal using the second correction data represented in spatial components.

14. The display device manufacturing method according to claim 13, wherein, in the transforming, the first correction data is transformed by deconstructing the first color correction data and the second color correction data included in the first correction data into frequency components, removing a high frequency component greater than or equal to a first frequency from the deconstructed first color correction data to generate the first color correction data included in the second correction data, and removing a high frequency component greater than or equal to a second frequency lower than the first frequency from the deconstructed second color correction data to generate the second color correction data included in the second correction data.

15. The display device manufacturing method according to claim 13, wherein, in the transforming, the first correction data is transformed into the second correction data by reconstructing correction data components corresponding to the first sub pixels by, for each of the first sub pixels, propagating an error component of a correction data component corresponding to a current first sub pixel to a neighboring first sub pixel, and reducing the reconstructed correction data components corresponding to the first sub pixels by a first number of bits; and reconstructing correction data components corresponding to the second sub pixels by, for each of the second sub pixels, propagating an error component of a correction data component corresponding to a current second sub pixel to a neighboring second sub pixel, and reducing the reconstructed correction data components corresponding to the second sub pixels by a second number of bits greater than the first number of bits.

16. A display device display method for a display device including a matrix of pixels each including a light emitting element that emits light in accordance with a luminance signal, the display device display method comprising:

correcting the luminance signal using second correction data generated by (i) obtaining, in advance, first correction data for correcting the luminance signal, the first correction data including correction data components corresponding to the pixels, (ii) removing high frequency components of the first correction data by executing a low-pass filter function, and (iii) transforming the first correction data into second correction data smaller in data size than the first correction data; and supplying the luminance signal corrected in the correcting to the pixels to cause the light emitting element to emit light in accordance with the luminance signal and the display device to display an image, wherein the pixels each include at least a first sub pixel that emits light of a first color, a second sub pixel that emits light of a second color, and a third sub pixel that emits light of a third color, the first correction data and the second correction data respectively include at least first color correction data for correcting a luminance of the first sub pixel, second color correction data for correcting a luminance of the second sub pixel, and third color correction data for correcting a luminance of the third sub pixel, in the transforming, the first correction data is transformed such that a data reduction amount of the second color correction data is greater than a data reduction amount of the first color correction data, and in the correcting, a corrector is used that includes a spatial component inverse transformer that applies an inverse transform to the second correction data represented in low frequency components to yield second correction data represented in spatial components, and a luminance signal corrector that corrects the luminance signal using the second correction data represented in spatial components.

17. The display device display method according to claim 16, wherein, in the transforming, the first correction data is transformed by deconstructing the first color correction data and the second color correction data included in the first correction data into frequency components, removing a high frequency component greater than or equal to a first frequency from the deconstructed first color correction data to generate the first color correction data included in the second correction data, and removing a high frequency component greater than or equal to a second frequency lower than the first frequency from the deconstructed second color correction data to generate the second color correction data included in the second correction data.

18. The display device display method according to claim 16, wherein, in the transforming, the first correction data is transformed into the second correction data by reconstructing correction data components corresponding to the first sub pixels by, for each of the first sub pixels, propagating an error component of a correction data component corresponding to a current first sub pixel to a neighboring first sub pixel, and reducing the reconstructed correction data components corresponding to the first sub pixels by a first number of bits; and reconstructing correction data components corresponding to the second sub pixels by, for each of the second sub pixels, propagating an error component of a correction data component corresponding to a current second sub pixel to a neighboring second sub pixel, and reducing the reconstructed correction data components corresponding to the second sub pixels by a second number of bits greater than the first number of bits.

19. A display device including a matrix of pixels each including a light emitting element that emits light in accordance with a luminance signal, the display device comprising:

a transformer configured to function as a low-pass filter to remove high frequency components of the first correction data, and transform first correction data for correcting the luminance signal into second correction data smaller in data size than the first correction data, the first correction data including correction data components corresponding to the pixels; and a corrector configured to correct the luminance signal using the second correction data, wherein the pixels each include at least a first sub pixel that emits light of a first color, a second sub pixel that emits light of a second color, and a third sub pixel that emits light of a third color, the first correction data and the second correction data respectively include at least first color correction data for correcting a luminance of the first sub pixel, second color correction data for correcting a luminance of the second sub pixel, and third color correction data for correcting a luminance of the third sub pixel, and the transformer is configured to transform the first correction data such that a data reduction amount of the second color correction data is greater than a data reduction amount of the first color correction data, wherein the corrector includes a spatial component inverse transformer that applies an inverse transform to the second correction data represented in low frequency components to yield second correction data represented in spatial components, and a luminance signal corrector that corrects the luminance signal using the second correction data represented in spatial components.

20. The display device according to claim 19, wherein the transformer is configured to deconstruct the first color correction data and the second color correction data included in the first correction data into frequency components, remove a high frequency component greater than or equal to a first frequency from the deconstructed first color correction data to generate the first color correction data included in the second correction data, and remove a high frequency component greater than or equal to a second frequency lower than the first frequency from the deconstructed second color correction data to generate the second color correction data included in the second correction data.

21. The display device according to claim 19, wherein the transformer is configured to transform the first correction data into the second correction data by reconstructing correction data components corresponding to the first sub pixels by, for each of the first sub pixels, propagating an error component of a correction data component corresponding to a current first sub pixel to a neighboring first sub pixel, and reducing the reconstructed correction data components corresponding to the first sub pixels by a first number of bits; and reconstructing correction data components corresponding to the second sub pixels by, for each of the second sub pixels, propagating an error component of a correction data component corresponding to a current second sub pixel to a neighboring second sub pixel, and reducing the reconstructed correction data components corresponding to the second sub pixels by a second number of bits greater than the first number of bits.

* * * * *